United States Patent [19]

Watanabe

[11] Patent Number: 4,755,855

[45] Date of Patent: Jul. 5, 1988

[54] IMAGE FORMING APPARATUS WITH A FORMING POSITION CORRECTING FUNCTION

[75] Inventor: Junji Watanabe, Yokohama, Japan

[73] Assignee: Kabushiki Kaisha Toshiba, Kawasaki-shi, Japan

[21] Appl. No.: 868,281

[22] Filed: May 29, 1986

[30] Foreign Application Priority Data

May 30, 1985 [JP] Japan ..... 60-117228
May 31, 1985 [JP] Japan ..... 60-118151

[51] Int. Cl.[4] ..... G03G 15/04
[52] U.S. Cl. ..... 355/14 SH
[58] Field of Search ..... 355/14 SH, 3 SH, 14 R; 271/227, 229, 236

[56] References Cited

U.S. PATENT DOCUMENTS 4,538,905 9/1985 Griego et al. ..... 355/14 SH
4,639,121 1/1987 Looney ..... 355/14 SH

*Primary Examiner*—R. L. Moses
*Attorney, Agent, or Firm*—Schwartz, Jeffery,Schwaab, Mack, Blumenthal & Evans

[57] ABSTRACT

An image forming apparatus with forming position correcting function comprises an original table, an original scanning section for optically scanning an original placed on the original table to obtain image data that corresponds to the image of the original, an image forming medium feeding section for feeding an image forming medium to a given feeding path, an image forming section for forming an image corresponding to the image data obtained by the original scanning section on a sheet of the image forming medium with a given magnification, a positional diversion detecting section for detecting a quantity of any positional diversion of the image forming medium in the direction of its feeding and in the direction rectangular to its feeding direction, a positional diversion storing section for storing the data for any positional diversions detected by the positional diversion detecting section, a first control section for generating forming position correcting data in response to the positional diversion data that have been read out from the positional diversion storing section, and a second control section for the transmitting the forming position correcting data generated by the first control section to a part which substantially affects the forming position on the image forming medium by the image forming section.

9 Claims, 24 Drawing Sheets

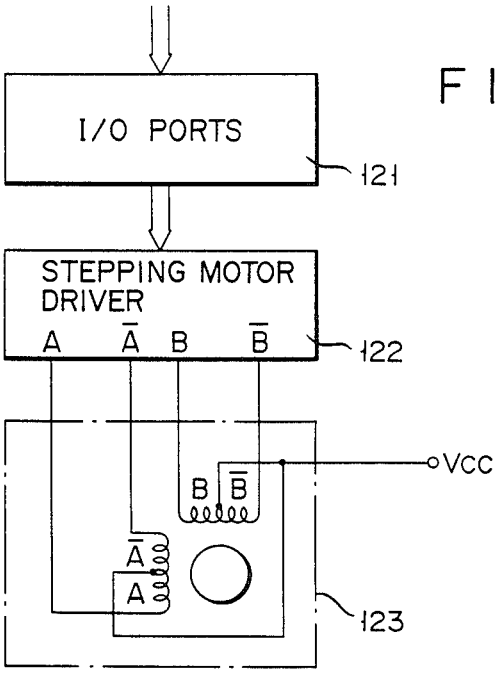
FIG. 13
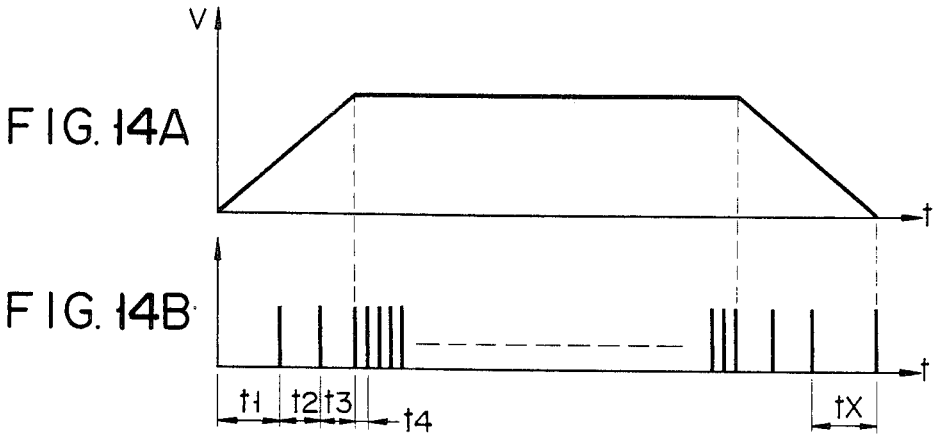
FIG. 14A
FIG. 14B

IMAGE FORMING APPARATUS WITH A FORMING POSITION CORRECTING FUNCTION

BACKGROUND OF THE INVENTION

This invention relates to an image forming apparatus with a forming position correcting function and, more particularly, to an image forming apparatus suitable for an electronic copying machine in which, when two sets of image forming procedures are conducted to form a final image on a same sheet of image receiving medium, any discrepancies concerning positioning of the image between said two sets of procedures are eliminated by a forming position correcting function.

A conventional copying machine having a function of forming an image on both sides of a sheet of copying paper and a copying machine having a function of forming multiple images on a single sheet of copying paper as well as a copying machine having these two functions are already known.

In any of the aforementioned types of copying machines, a single sheet of copying paper is moved back to the copying post after completion of a first set of image forming procedures to undergo a second set of image forming procedures. If, in such a type of machine, a sheet of copying paper is to travel a long way for a second set of copying procedures or it is temporarily stored in a paper stack section on its way back to the copying post, it can be diverted longitudinally and/or laterally so that it may come back to the same position as it was located when it underwent the first set of copying procedures. Such positional discrepancies can adversely affect the quality of the final image particularly when multiple sets of image forming procedures are conducted on a same sheet of copying paper.

In a copying machine, in which two developing units are incorporated for two different colors, black and red for example, a sheet of copying paper is fed to a first developing unit, for black color for example, for the first set of copying procedures and then to a second developing unit for the second set of copying procedures.

In this type of copying machine, any positional deviation, longitudinal and/or lateral, at the first copying post can be carried over to the second copying post without any corrective measures, causing a blurred or smeared final image in most cases.

SUMMARY OF THE INVENTION

It is therefore an object of the present invention to provide a new and improved image forming apparatus with a forming position correcting function which can prevent any positional deviation, longitudinal and/or lateral, of the image that is formed on an image receiving medium and hence provides a quality formed image.

According to the present invention, there is provided an image forming apparatus with a forming position correcting function, said apparatus comprising:

an original table, original scanning means for optically scanning an original placed on said original table to obtain image data that corresponds to the image of said original, image receiving medium feeding means for feeding an image receiving medium to a given feeding path, image forming means for forming an image corresponding to said image data obtained by said original scanning means on said image receiving medium with a given magnification, positional deviation detecting means for detecting a quantity of any positional deviation of said image forming medium in the direction of its feeding and in the direction perpendicular to its feeding direction, positional deviation storing means for storing the data for any positional deviation detected by said positional deviation detecting means, first control means for generating forming position correcting data in response to the positional deviation data that have been read out from said positional deviation storing means, and second control means for transmitting said forming position correcting data generated by said first control means to a positioning means which substantially affects the forming position on said image receiving medium by said image forming means.

BRIEF DESCRIPTION OF THE DRAWINGS

These and other objects and features of the present invention can be understood through the following embodiment by reference to the accompanying drawings.

FIGS. 1 to 17 show a first embodiment of an image forming apparatus according to the present invention, in which:

FIGS. 1 and 2 are a schematic perspective view and a side sectional view, respectively, showing the construction of the image forming apparatus;

FIG. 3 is a plan view of a control panel;

FIG. 4 is a perspective view showing an arrangement of drive sections;

FIG. 5 is a perspective view schematically showing a drive mechanism for an optical system;

FIG. 6 is a perspective view schematically showing a drive mechanism for indexes;

FIG. 7 is a perspective view schematically showing a variable magnification lens drive mechanism;

FIG. 9 is a block diagram showing a general control circuit;

FIG. 10 is a functional block diagram of a main processor group;

FIG. 11 is a functional block diagram of a first sub-processor group;

FIG. 12 is a functional block diagram of a second sub-processor group;

FIG. 13 is a block diagram of a pulse motor control circuit;

FIGS. 14A and 14B are charts for explaining a method of controlling pulse motor speed;

FIG. 16 is a flow chart for explaining a positional deviation detecting operation; and FIG. 17 is a perspective view of a modified embodiment of a first optical detector according to the present invention; and FIGS. 18 to 26 show a second embodiment of an image forming apparatus according to the present invention, in which:

FIGS. 18, 19 and 20 are schematic perspective views of the image forming apparatus;

FIG. 21 is a side sectional view showing a main part of FIG. 20;

FIG. 22 is a side sectional view showing the construction of the image forming apparatus;

FIG. 23 is a plan view showing an arrangement of a control panel;

FIG. 24 is a block diagram of an overall control circuit;

FIG. 26 is a schematic illustration for explaining the operation of the image forming apparatus.

DETAILED DESCRIPTION OF THE PREFERRED EMBODIMENTS

Figure 1:
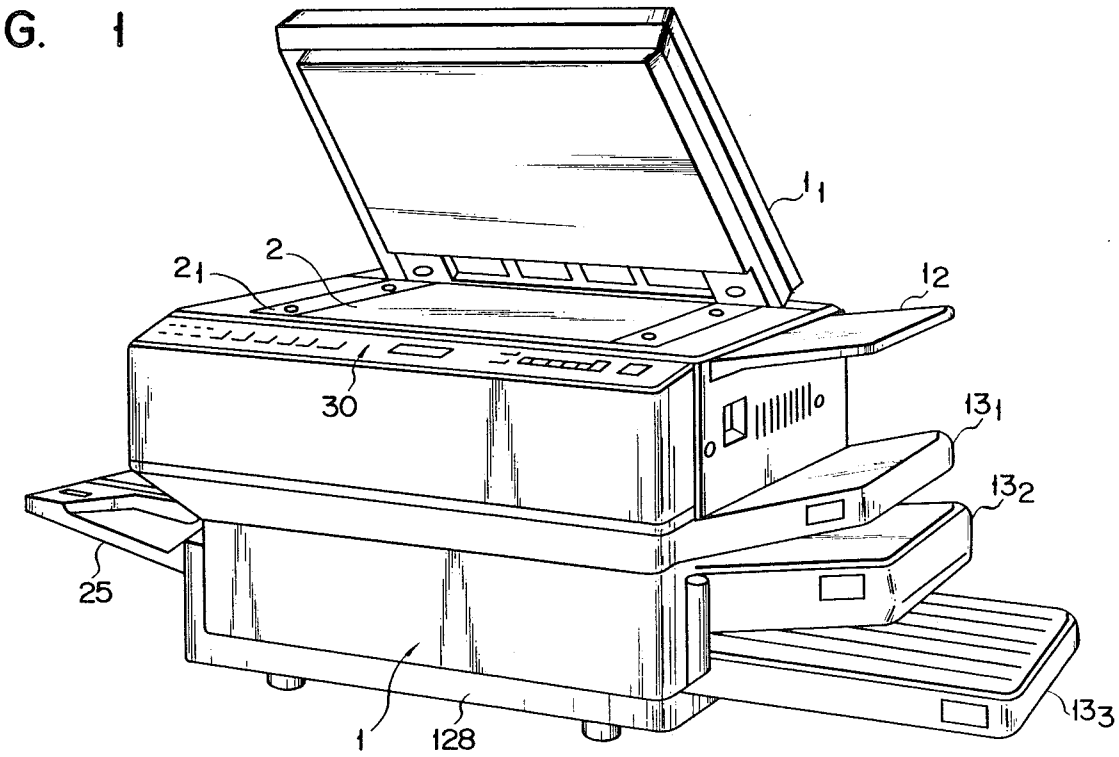
Figure 2:
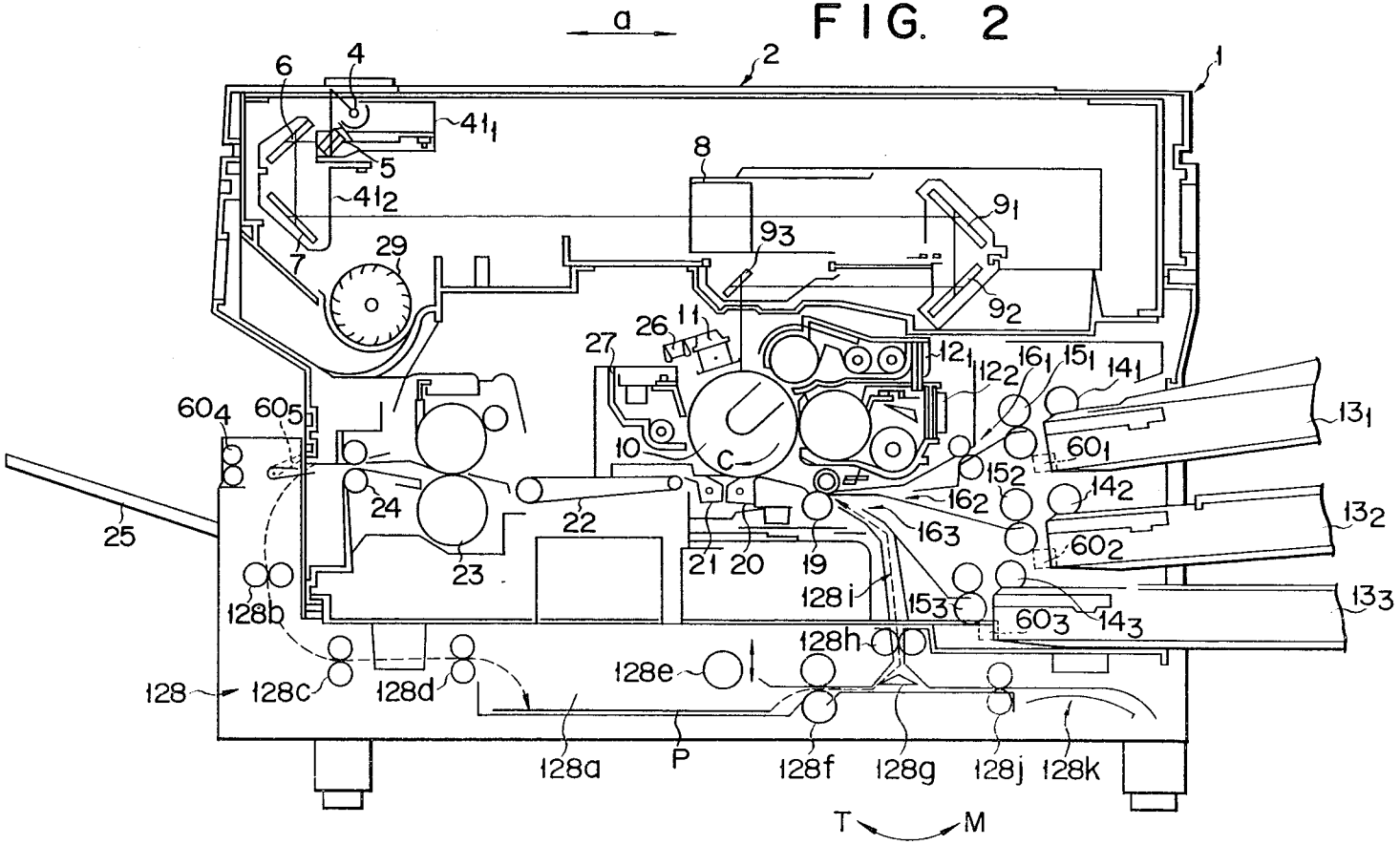

FIGS. 1 and 2 schematically show a copying machine as an image forming apparatus according to a first embodiment of the present invention. Reference numeral 1 denotes a copying machine housing. An original table (i.e., a transparent glass) 2 is fixed on the upper surface of the housing 1. An openable original cover $1_1$ and a word table $1_2$ are arranged near the table 2. A fixed scale $2_1$ as a reference for setting an original is arranged at one end of the table 2 along the longitudinal direction thereof.

The original set on the original table 2 is scanned for image exposure as an optical system including an exposure lamp 4 and mirrors 5, 6 and 7 reciprocates in the direction indicated by arrow a along the under surface of the original table 2. In this case, the mirrors 6 and 7 move at a speed half that of the mirror 5 so as to maintain a fixed optical path length.

A reflected light beam from the original scanned by the optical system 3, that is, irradiated by the exposure lamp 4, is reflected by the mirrors 5, 6 and 7, transmitted through a lens block 8 for magnification or reduction, and then reflected by a mirror $9_1$, $9_2$, $9_3$ to be projected on a photosensitive drum 10. Thus, an image of the original is formed on the surface of the photosensitive drum 10.

The photosensitive drum 10 rotates in the direction indicated by arrow c so that its surface is wholly charged first by a main charger 11.

The latent image formed on drum 10 is applied with red or black toner by developing units $12_1$ and $12_2$, which are selectively operated so that the latent image can be produced as a visible image. Meanwhile, sheets (image receiving media) P are selectively fed by feed rollers $14_1$, $14_2$ and $14_3$ and roller pairs $15_1$, $15_2$ and $15_3$ from upper, middle and lower cassettes $13_1$, $13_2$ and $13_3$ one by one. Each sheet is guided to aligning roller pair 19 along guide path $16_1$, $16_2$ and $16_3$ and is fed by pair 19 to the transfer section. It should be noted that cassettes $13_1$, $13_2$ and $13_3$ are detachably attached to the lower portion at the right side of housing 1. One of the cassette must be selected to the operation panel (to be described later). Sizes of casssettes $13_1$, $13_2$ and $13_3$ are detected by cassette size detection switches $60_1$, $60_2$ and $60_3$, respectively. Switches $60_1$, $60_2$ and $60_3$ comprise a plurality of microswitches which are turned on/off upon the insertion of cassettes of different sizes.

The paper sheet P delivered to the transfer region comes into intimate contact with surface of the photosensitive drum 10, in the space between a transfer charger 20 and the drum 10. As a rsult, the toner image on the photosensitive drum 10 is transferred to the paper sheet P by the agency of the charger 20. After the transfer, the paper sheet P is separated from the photosensitive drum 10 by a separation charger 21 and transported by a conveyor belt 22. Thus, the paper sheet P is delivered to a fixing roller pair 23 as a fixing unit arranged at the terminal end portion of the conveyor belt 22. As the paper sheet P passes through the fixing roller pair 23, the transferred image fixed on the sheet P. After the fixation, the paper sheet P is discharged into a tray 25 outside the housing 1 by two exit roller pairs 24, $60_4$.

After the transfer, moreover, the photosensitive drum 10 is de-electrified by a de-electrification charger 26, when the residual toner on the surface of the drum 10 is removed by a cleaner 27. Thereafter, a residual image on the photosensitive drum 10 is erased by a discharge lamp 23 to restore the initial state. In FIG. 2, numeral 29 designates a cooling fan for preventing the temperature inside the housing 1 from rising.

Two-side multicopying unit 128 is arranged at the lower portion of housing 1 to perform two-side copying or multicopying for copying different images on the same sheet surface. Unit 128 has selection gate $60_5$, discharge roller pair $60_4$, and a plurality of roller pairs 128*b*, 128*c* and 128*d* for guiding the sheet from gate $60_5$ to stacking portion 128*a*. Feedout roller 128*e* is arranged in portion 128*a* to feed out the sheets temporarily stacked in portion 128*a*. Roller 128*e* can be moved vertically in the direction of the arrow in accordance with the thickness (number) of stacked sheets. The sheets fed by roller 128*e* are separated by separation roller pair 128*f* one by one, and each sheet is guided to control gate 128*g*. Gate 128*g* is pivoted in the M direction when multicopying is performed, so that the sheet is guided to roller pair 19 through convey roller pair 128*h* along sheet guide path 128*i*. However, when two-side copying is performed, gate 128*g* , so that the sheet is guided to inverting portion 128*k* through roller pair 128*j*. When the sheet is fed to portion 128*k*, gate 128*g* is pivoted in the T direction, so that it is guided to pair 19 through pair 128*h* along path 128*i*.

Figure 3:
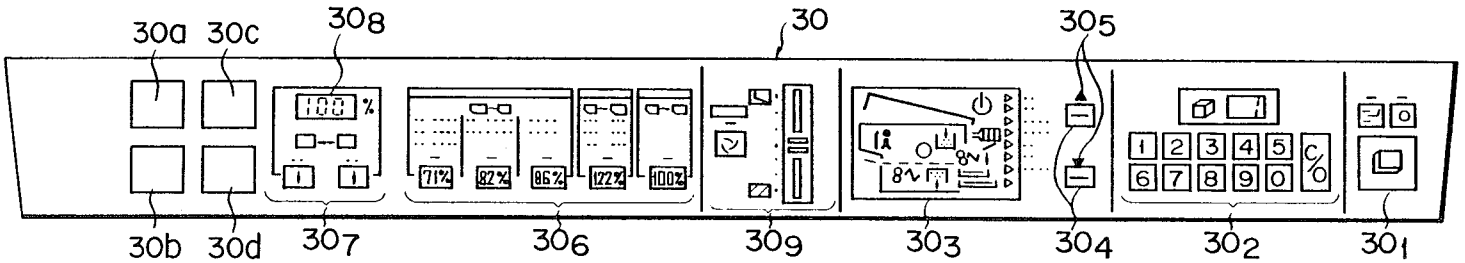

FIG. 3 shows a control panel 30 mounted on the housing 1. The control panel 30 carries thereon a copy key $30_1$ for starting the copying operation, ten-keys $30_2$ for setting the number of copies to be made and the like, a display section $30_3$ for indicating the operating conditions of the individual parts or paper jamming, cassette selection keys $30_4$ for alternatively selecting the upper or median or lower paper cassette $13_1$ or $13_2$ or $13_3$, and cassette display sections $30_5$ for indicating the selected cassette. The control panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density, 30*a* designates a multiplex copying specifying key, 30*b* designates a both sides copying specifying key, 30*c* designates a red color specifying key for operating a developing unit $12_1$ containing red toner and 30*d* designates a black color specifying key for operating a developing unit $12_2$ containing black toner.

Figure 4:
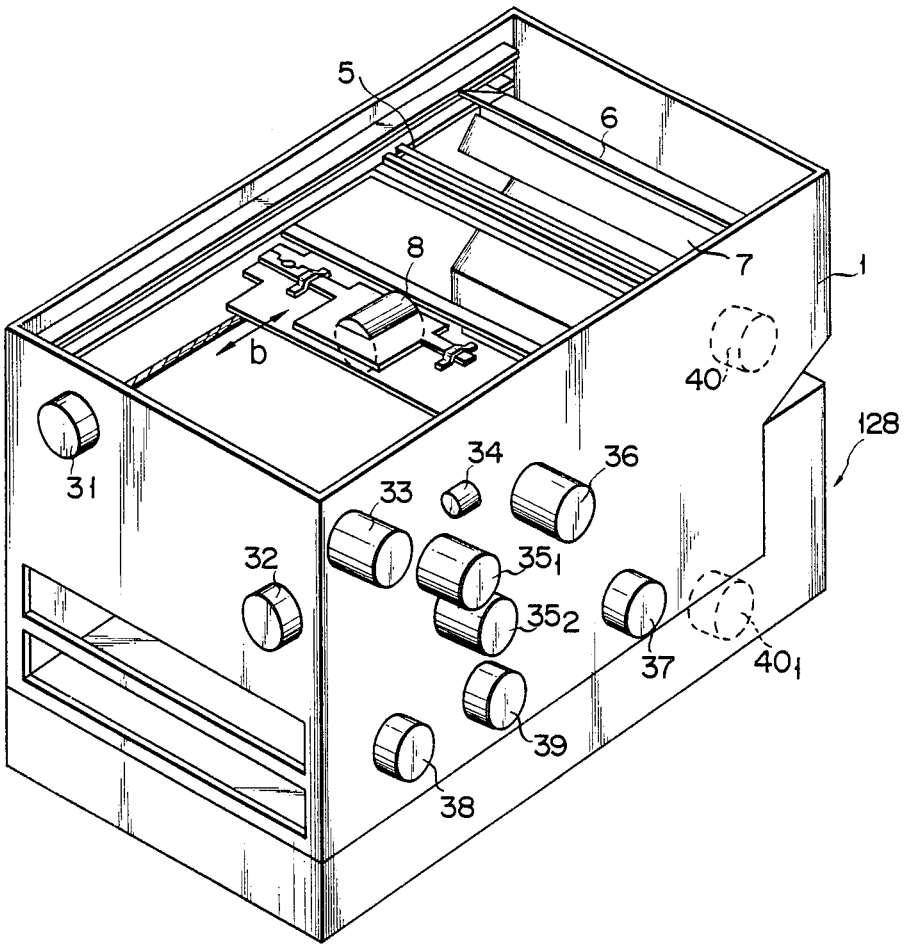

FIG. 4 shows a specific arrangement of drive sources for individual drive sections of the copying machine constructed in the aforesaid manner. The drive sources include the following motors. Numeral 31 designates a motor for lens drive. The lens drive motor 31 serves to shift the position of the lens block 8 for magnification or reduction. Numeral 32 designates a motor for mirror drive. The mirror drive motor 32 serves to change the distance (optical path length) between the mirror 5 and the mirrors 6 and 7 for magnification or reduction. Numeral 33 designates a stepping motor for scanning. The stepping motor 33 serves to move the exposure lamp 4 and the mirrors 5, 6 and 7 for scanning the original. Numeral 34 designates a motor for shutter drive. The shutter motor 34 serves to move a shutter (not shown) for adjusting the width of charging of the photosensitive drum 10 by the charger 11 at the time of magnification or reduction.

Numerals $35_1$ and $35_2$ designate motors used for developing. The developing motors $35_1$, $35_2$ serve to drive the developing roller and the like of the developing units $12_1$, $12_2$. Numeral 36 designates a motor used to drive the drum. The drum drive mtor 36 serves to drive the photosensitive drum 10. Numeral 37 designates a motor for fixation. The fixing motor 37 serves to drive the sheet conveyor belt 22, the fixing roller pair 23, and the exit roller pair $60_4$. Numeral 38 designates a motor for paper supply. The paper supply motor 38 serves to drive the paper-supply rollers $14_1$, $14_2$ and $14_3$. Numeral 39 designates a motor for feeding sheets. The sheet feed motor 39 serves to drive the aligning roller pair 19. Numeral 40 designates a motor for fan drive. The fan drive motor 40 serves to drive the cooling fan 29. Numeral $40_1$, a motor for driving roller pairs 128*a* to 128*d*, etc. and feed roller 128*e*.

Figure 5:
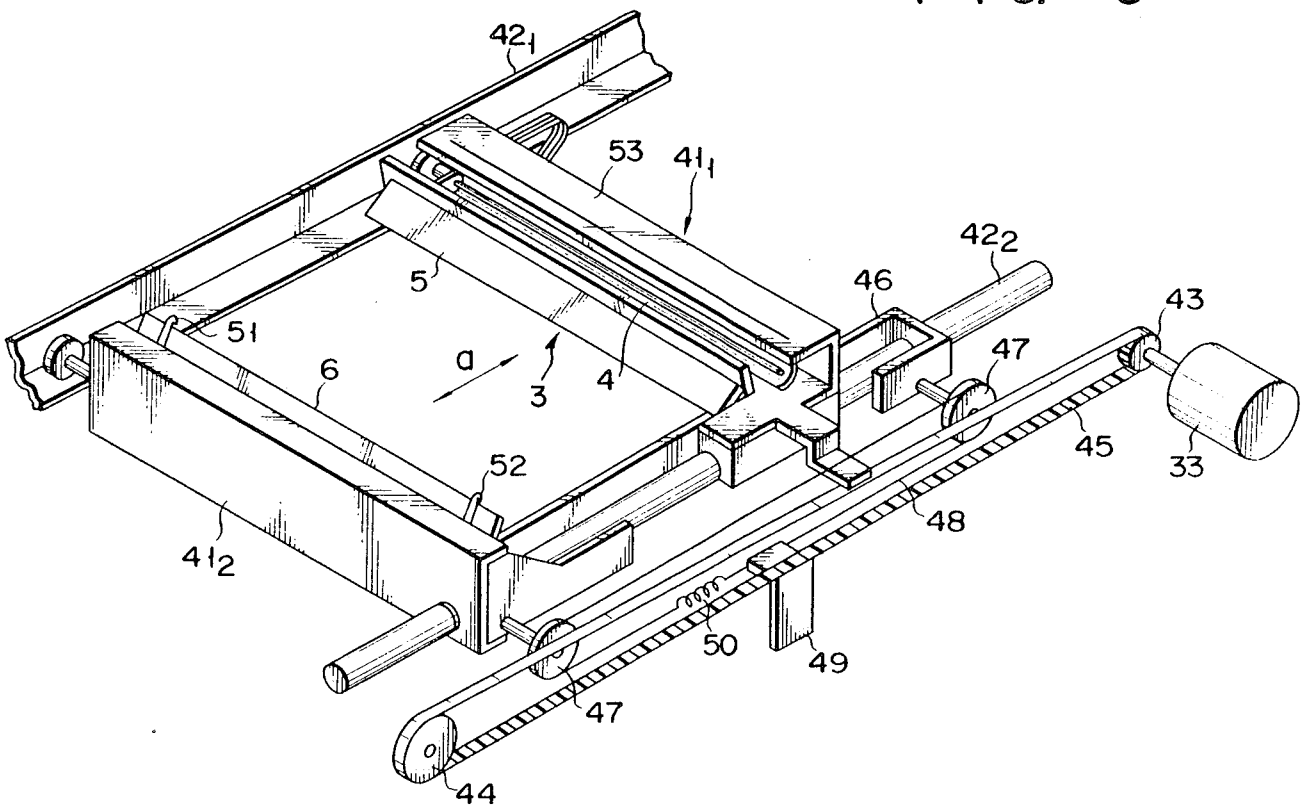

FIG. 5 shows a drive mechanism for reciprocating the optical system. The mirror 5 and the exposure lamp 4 are supported by a first carriage $41_1$, and the mirrors 6 and 7 by a second carriage $41_2$. These carriages $41_1$ and $41_2$ can move parallel in the direction indicated by arrow a, guided by guide rails $42_1$ and $42_2$. The four-phase stepping motor 33 drives a pulley 43. An endless belt 45 is stretched between the pulley 43 and an idle pulley 44, and one end of the first carriage $41_1$ supporting the mirror 5 is fixed to the middle portion of the belt 45.

On the other hand, two pulleys 47 are rotatably attached to a guide portion 46 (for the rail $42_2$) of the second carriage $41_2$ supporting the mirrors 6 and 7, spaced in the axial direction of the rail $42_2$. A wire 48 is stretched between the two pulleys 47. On end of the wire 48 is connected directly to a fixed portion 49, while the other end is connected thereto by means of a coil spring 50. The one end of the first carriage $41_1$ is fixed to the middle portion of the wire 48.

With this arrangement, when the stepping motor 33 is driven, the belt 45 turns around to move the first carriage $41_1$. As the first carriage $41_1$ travels, the second carriage $41_2$ also travels. Since the pulleys 47 then serve as movable pulleys, the second carriage $41_2$ travels in the same direction as and at a speed half that of the first carriage $41_1$ . The traveling direction of the first and second carriages $41_1$ and $41_2$ is controlled by changing the rotating direction of the stepping motor 33.

The original table 2 carries thereon an indication of a reproducible range corresponding to the size of designated paper sheets. If the shseet size designated by the sheet selection keys $30_4$ and the copy ratio specified by the ratio setting keys $30_6$ or $30_7$ are (Px, Py) and K, respectively, the reproducible range (x, y) is given by $$x=Px/K,$$

$$y=Py/K.$$

Out of the coordinates (x, y) designating any point within the reproducible range, as shown in FIG. 1, the x coordinate is indicated by indexes 51 and 52 arranged on the inside of the original table 2, and the y coordinate by a scale 53 provided on the top face portion of the first carriage $41_1$.

Figure 6:
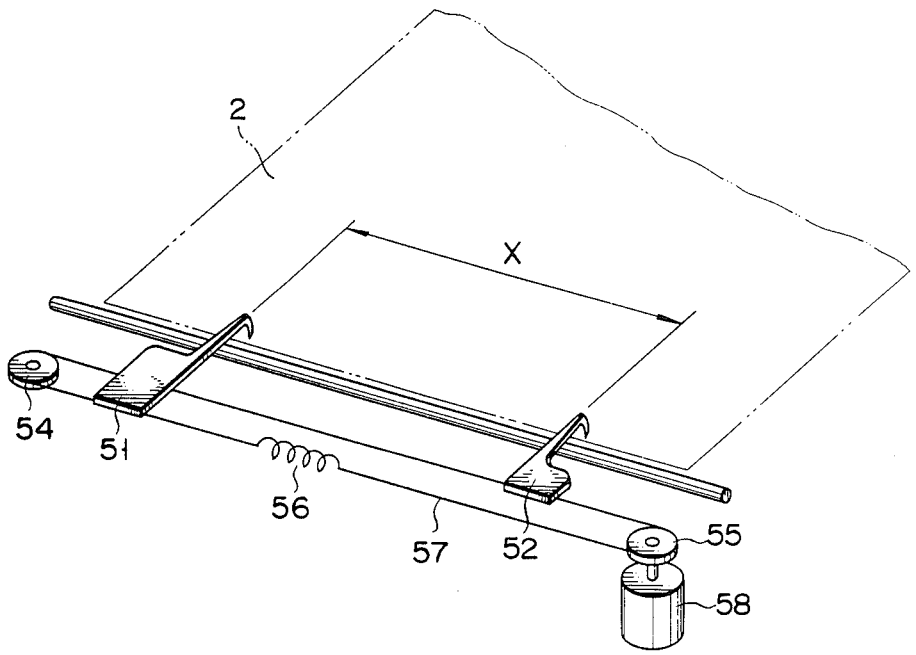

As shown in FIG. 6, the indexes 51 and 52 are attached to a wire 57 which is stretched between pulleys 54 and 55 through the aid of a spring 56. The pulley 55 is rotated by a motor 58. The distance between the indexes 51 and 52 can be changed by driving the motor 58 in accordance with the sheet size and the enlargement or reduction ratio.

The first carriage $41_1$ moves to a predetermined position (home position depending on the enlargement or reduction ratio) as the motor 33 is driven in accordance with the sheet size and the ratio. When the copy key $30_1$ is depressed, the first carriage $41_1$ is first moved toward the second carriage $41_2$. The, lamp 4 is lighted and the first carriage $41_1$ is moved away from the second carriage $41_2$. When the original scanning ends, the lamp 4 is turned off, and the first carriage $41_1$ is returned to the home position.

Figure 7:
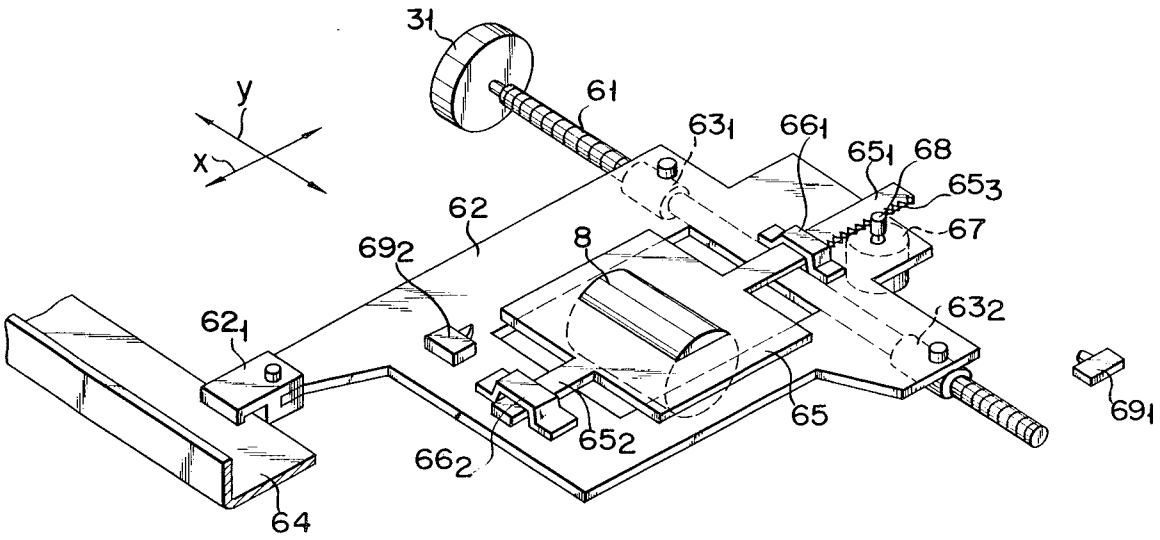

FIG. 7 shows a drive mechanism for block 8. Motor 31 drives lead screw 61 arranged along the moving direction (y direction) or carriage $41_1$. Bushings $63_1$ and $63_2$ disposed at one end of base plate 62 are meshed with screw 61. When screw 61 is rotated, plate 62 is moved along the y direction. Guide member $62_1$ is arranged at the other end of plate 62. Member $62_1$ is slidably engaged with guide rail 64. Movable member 65, upon which block 8 is mounted, is mounted on plate 62 and is movable along a direction (x direction) perpendicular to plate 62. Supports $65_1$ and $65_2$ are mounted at two ends of member 65 and are guided by guide members $66_1$ and $66_2$ mounted on plate 62. Rack $65_3$ is mounted on the side surface of support $65_1$ along its longitudinal direction. Pinion 68 is mounted on rack $65_3$ and can be rotated by pulse motor 67 mounted on plate 62. When motor 67 is driven, block 8 is moved along the x direction. It should be noted that microswitches $69_1$ and $69_2$ detect the initial positions of plate 62 and member 65, respectively.

Figure 8A:
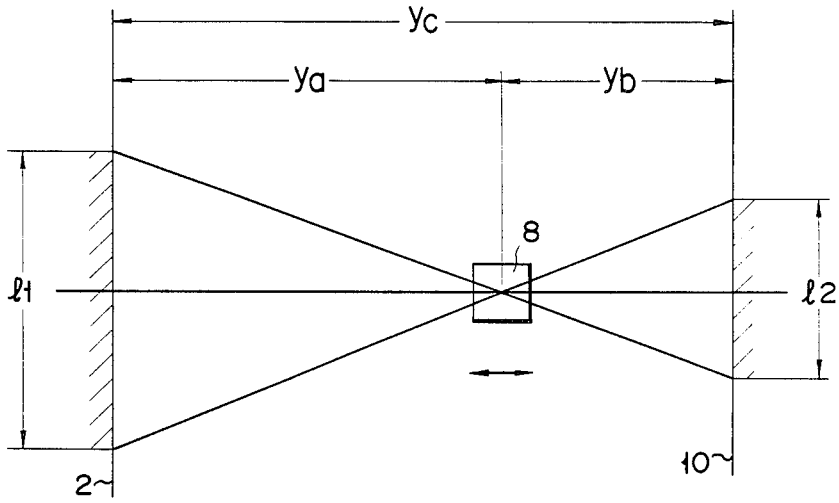
FIGS. 8A and 8B are representations for explaining the relationship between the variable lens block and the image to be formed.

The relationship between the operation of block 8 and the image to be formed will now be described. Referring to FIG. 8A, if the focal distance of block 8 is given by f, the optical path length between table 2 and block 8 is given by ya, the optical path length between block 8 and drum 10 is given by yb, and the overall optical path length between table 2 and drum 10 is given by yc, the following optical relation is derived:

$$1/f=1/ya+1/yb$$

A magnification K is thus given be:

$$K=yb/ya$$

Since focal distance f of block 8 is predetermined, it is apparent that length yc as well as length ya or yb must be changed to achieve the in-focus state in the variable magnification mode. Lengths ya and yb can be varied by moving block 8 in the y direction. Length yc can be varied by moving carriage $41_2$ and changing the positions of mirrors 6 and 7.

Figure 8B:
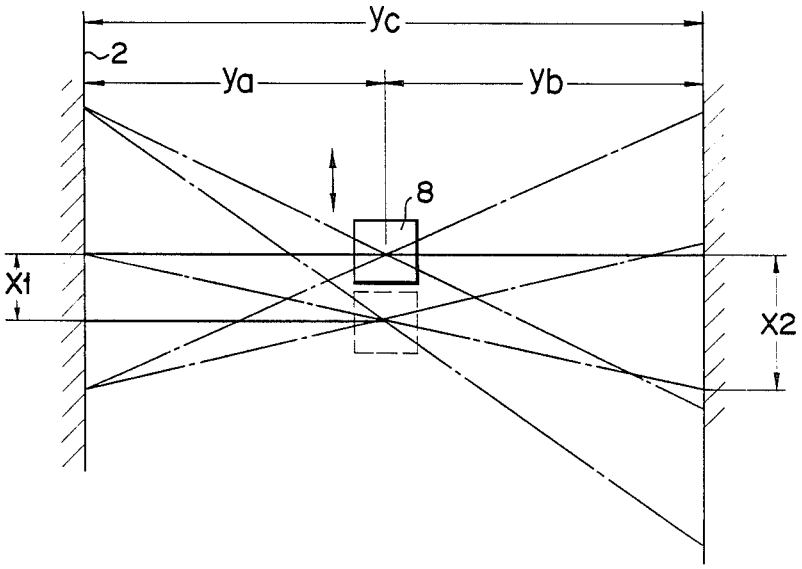

As shown in FIG. 8B, if the distances between table 2, block 8 and drum 10 are predetermined, and block 8 is moved by motor 67 by distance x1 along the x direction, an image on drum 10 can be shifted by distance x2, where x2 is given by:

$$x2=x1(yb/ya)$$

When an equal size mode is set, distance x2 is given by:

$$x2=2x1$$

In this manner, the center of the copied image can be shifted by moving block 8 along the x direction.

Figure 9:
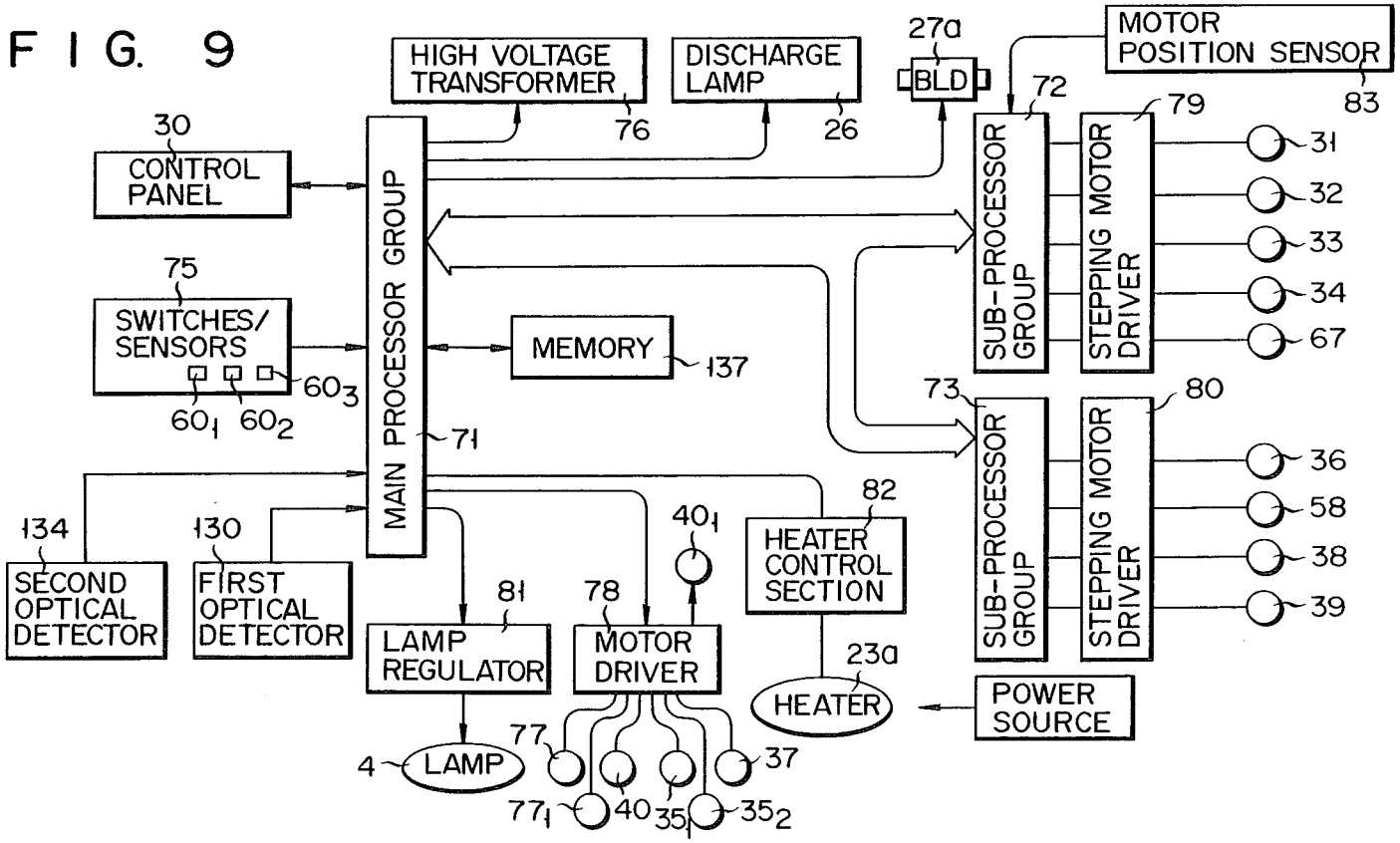

FIG. 9 shows a general control circuit of the electronic copying machine. This control circuit is mainly composed of a main processor group 71 and first and second sub-processor groups 72 and 73. The main processor group 71 detects input data from the control panel 30 and a group of input devices 75 including various switches and sensors, such as the cassette size detection switches $60_1$, $60_2$ and $60_3$ and controls a high-voltage transformer 76 for driving the chargers, the discharge lamp 28, a blade solenoid 27a of the cleaner 27, a heater 23a of the fixing roller pair 23, the exposure lamp 4, and the motors 31 to 40, 58 and 67, thus accomplishing the copying operation. Longitudinal and/or positional diversions are detected by the first and second optical detectors 130, 134 and the memory 137 and, in response to the detected diversions, a set of correcting procedures are conducted to adjust the position of the image relative to the copying paper by the main processor group 71. The first and second optical detectors 130, 131 and the memory 137 will be detailedly described later.

The motors $35_1$, $35_2$, 37 and 40, $40_1$ and a toner-supply motor 77, $77_1$ for supplying the toner to the developing units $12_1$, $12_2$ are connected through a motor driver 78 to the main processor group 71 to be controlled thereby. The motors 31 to 34 and 67 are connected through a stepping motor driver 79 to the first sub-processor group 72 to be controlled thereby. The motors 36, 38, 39 and 58 are connected through a stepping motor driver 80 to the second sub-processor group 73 to be controlled thereby.

Further, the exposure lamp 4 is controlled by the main processor group 71 through a lamp regulator 81, and the heater 23a by the main processor group 71 through a heater control section 82. The main processor group 71 gives instructions for the start or stop of the individual motors to the first and second sub-processor groups 72 and 73. Thereupon, the first and second sub-processor groups 72 and 73 feed the main processor group 71 with status signals indicative of the operation mode of the motors. Also, the first sub-processor group 72 is supplied with positional information from a position sensor 83 for detecting the respective initial positions of the motors 31 to 34 and 67.

Figure 10:
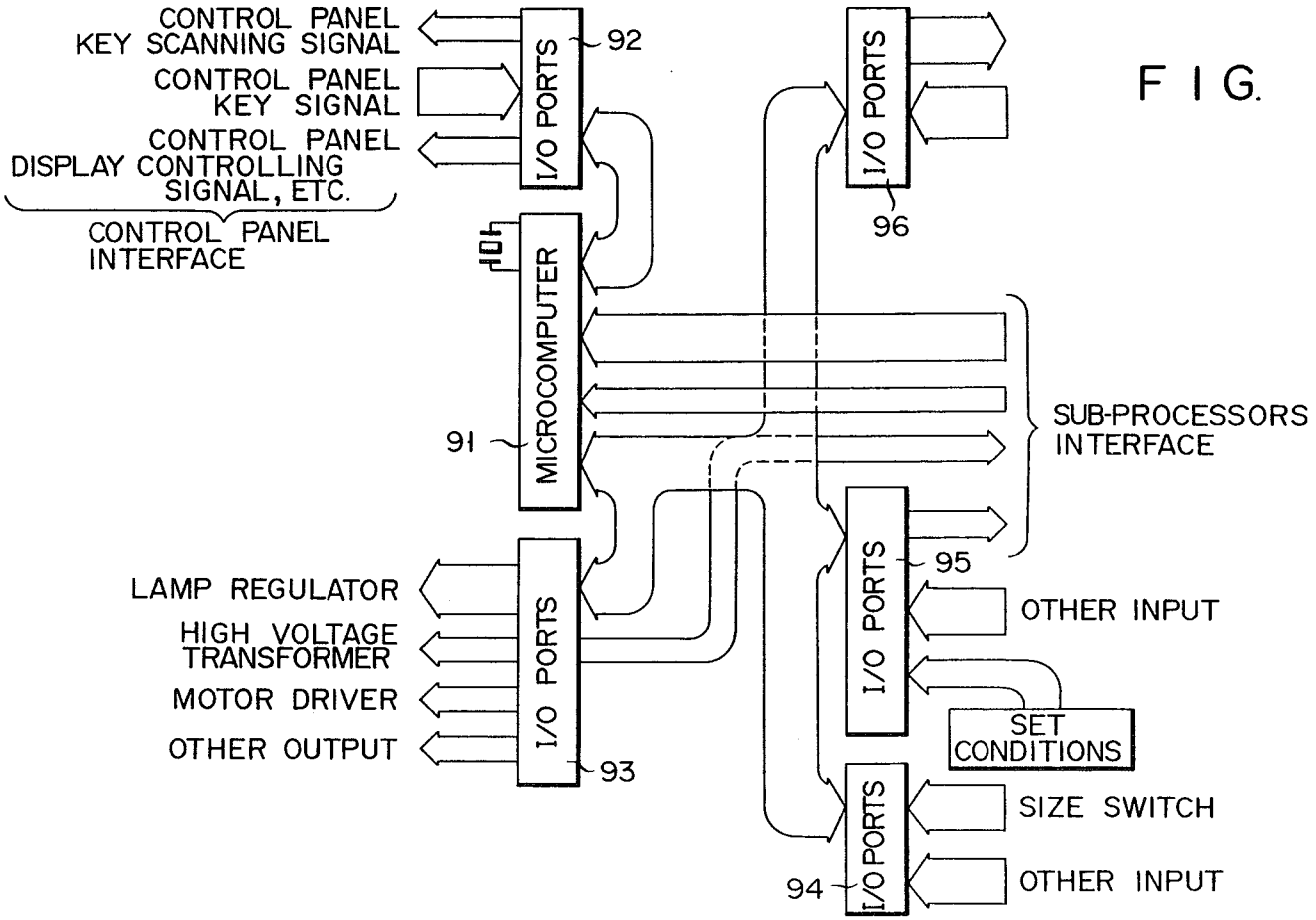

FIG. 10 shows an arrangement of the main processor group 71. Reference numeral 91 denotes a one-chip microcomputer (to be referred to as a CPU hereinafter). The CPU 91 detects key inputs at a control panel (not shown) through an I/O port 92 and control display operations. The CPU 91 can be expanded through I/O ports 93 to 96. The port 93 is connected to a high-voltage transformer 76, a motor driver 78, a lamp regulator 81 and other outputs. The port 94 is connected to a size switch for detecting a paper size and other inputs. The port 95 is connected to a copying condition setting switch and other inputs. The port 96 is optional.

Figure 11:
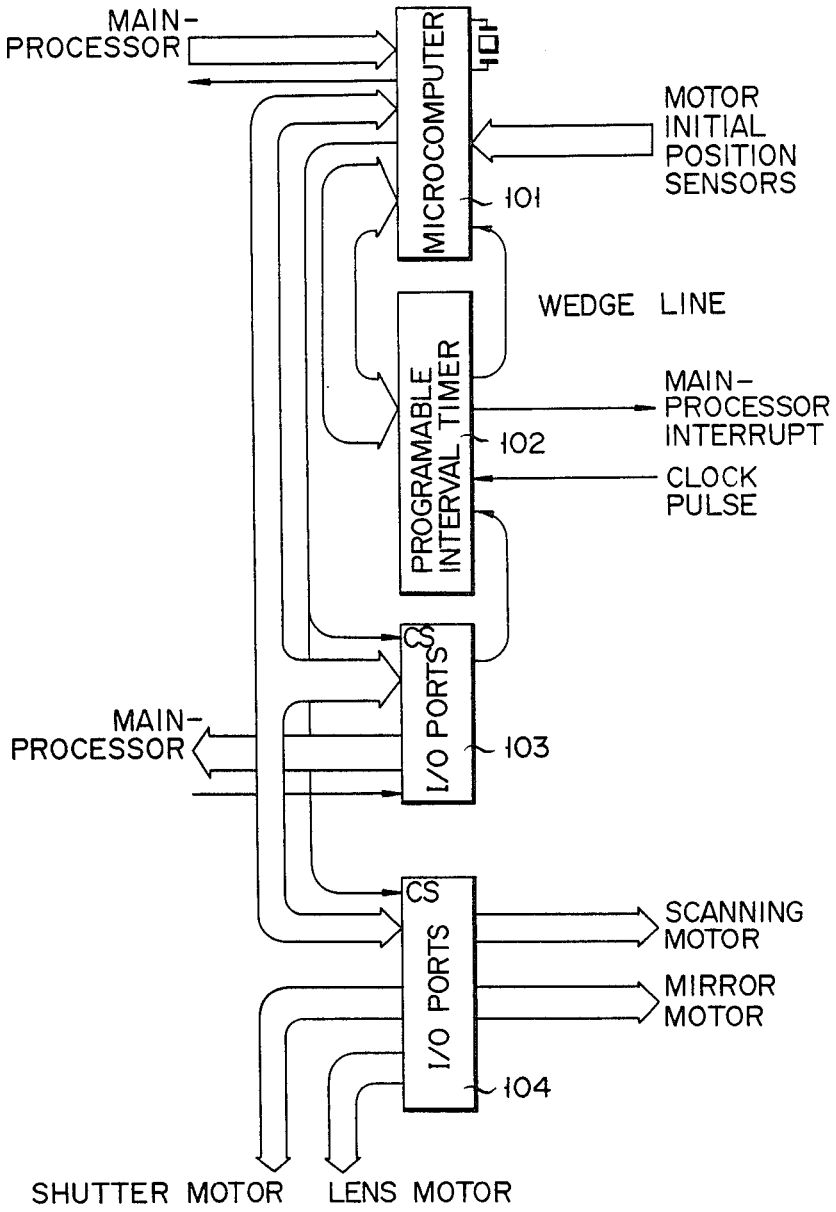

FIG. 11 shows an arrangement of the first sub-processor group 72. Reference numeral 101 denotes a CPU connected to the group 71. Reference numeral 102 denotes a programmable interval timer for controlling switching time intervals. A preset value from the CPU 101 is set in the programmable interval timer, and the timer is started. When the timer is stopped, the timer sends an end pulse onto an interrupt line of the CPU 101. The timer 102 receives a reference clock pulse. The CPU 101 receives position data from a position sensor 83 and is connected to I/O ports 103 and 104. The port 104 is connected to motors 31 to 34, 67 and 135 through the stepping motor driver 79. The port 103 is used to supply a status signal from each pulse motor to the group 71.

Figure 12:
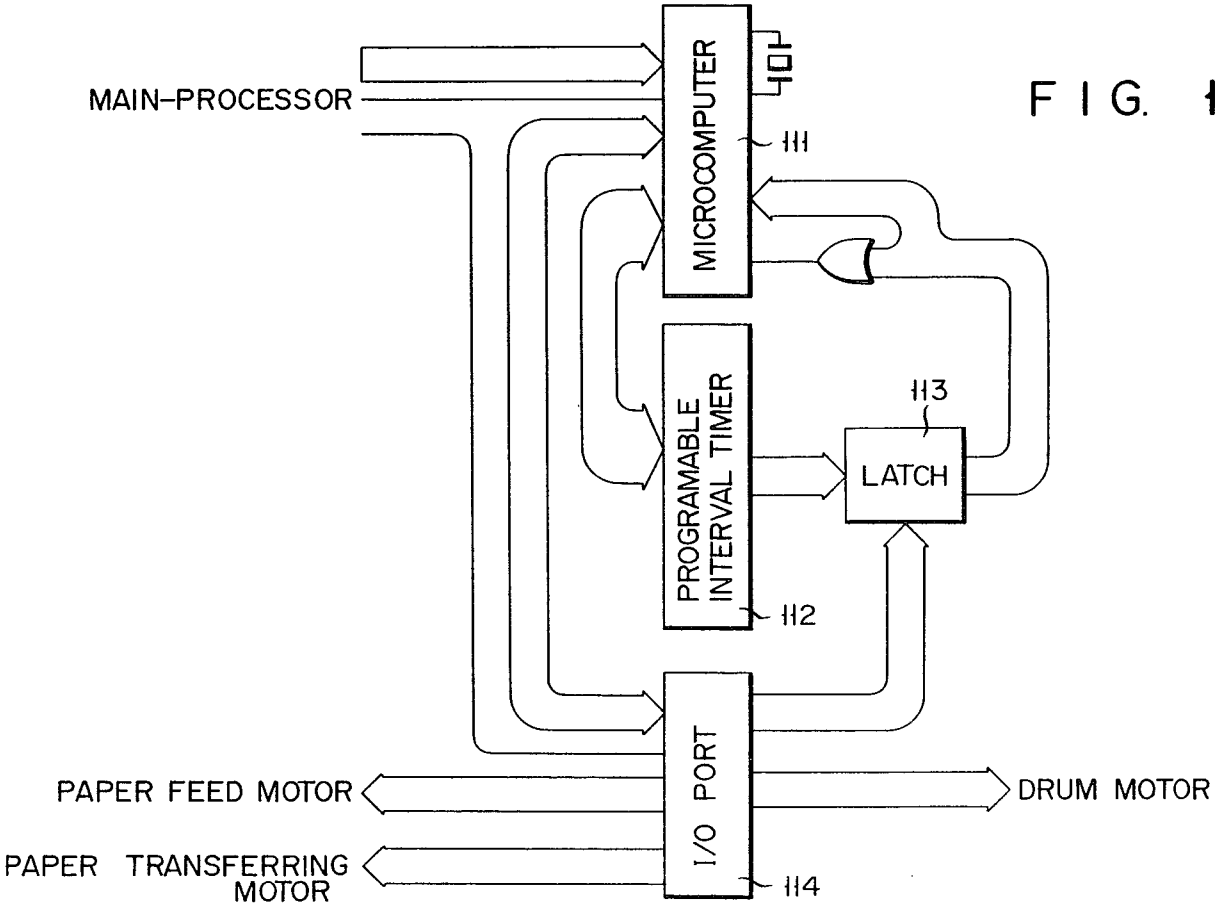

FIG. 12 shows an arrangement of the second sub-processor group 73. Reference numeral 111 denotes a CPU connected to the group 71. Reference numeral 112 denotes a programmable interval timer for controlling switching time intervals of the pulse motors. A preset value from the CPU 11 is set in the programmable interval timer, and the timer is started. When the timer is stopped, it generates an end pulse. The end pulse is latched by a latch 113, and an output therefrom is supplied onto the interrupt line of the CPU 111 and the input line of the I/O port. The CPU 111 is connected to an I/O port 114 which is then connected to motors 36, 38, 39 and 58 through the driver 80.

FIG. 13 shows a pulse motor control circuit. An I/O port 121 (corresponding to the ports 104 and 114 of FIGS. 11 and 12) is connected to a stepping motor driver 122 (corresponding to the drivers 79 and 80 of FIG. 9). The driver 122 is connected to windings A, $\overline{A}$, B and $\overline{B}$ of a stepping motor 123 (corresponding to the motors 31 to 34, 36, 38, 39, 58 and 67).

FIGS. 14A and 14B show a method of controlling a stepping motor speed. FIG. 14A shows a stepping motor speed curve, and FIG. 14B shows switching intervals. As is apparent from FIGS. 14A and 14B, the switching intervals are long at the beginning, are gradually decreased, and finally stop to decrease. Then, the intervals are prolonged, and the stepping motor is finally stopped. This cycle indicates the through-up and through-down of the pulse motor. The motor is started from the self starting region, operated in a high-speed region and is gradually stopped. Reference symbols $t_1$, $t_2$, . . . tx denotes times between the switching intervals.

Figure 15A:
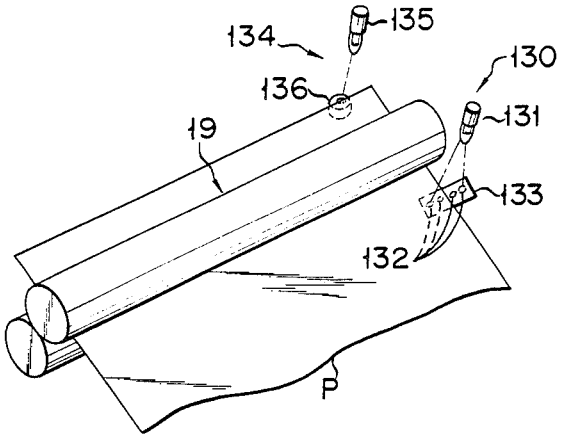
FIG. 15A is a perspective view of a principal area of the first and second optical detectors.
Figure 15B:
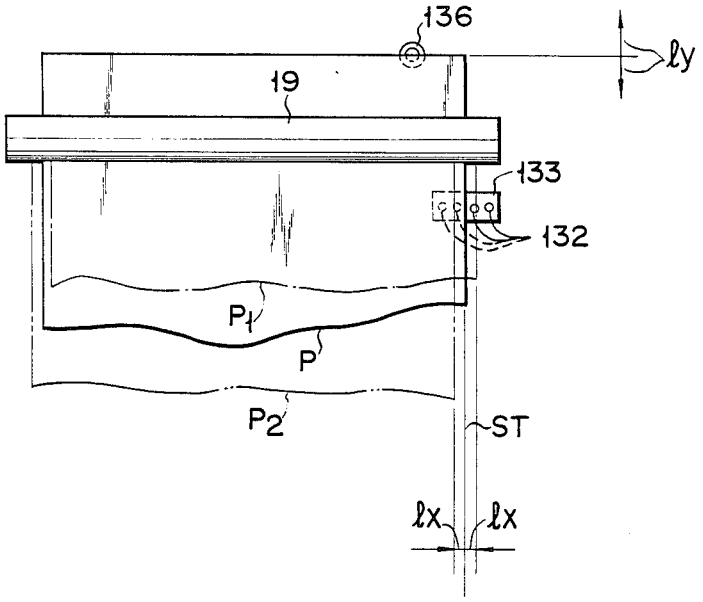
FIG. 15B is a plan view of a principal area illustrating positional diversions.

Now the present invention will be described in detail. The present embodiment can correct any positional (diversions) in the following way. As shown in FIG. 15A, said first optical detector 130 is provided in the upper stream of the roller pair 19 in the sense of the flow of the sheet P. The optical detector 130 comprises a light emitting element 131 and a group of light receiving elements 133 comprising a plurality of light receiving element 132, said light emitting element 131 and said light receiving element group 133 being spaced apart at a given distance in the direction perpendicular to the surface of the paper P. As seen in FIG. 15B, the median of a plurality of light receiving elements 132 is aligned to the transfer reference line ST for the sheet P. Thus, if the sheet P is moved from the reference line ST to the position as indicated by $P_1$ of $P_2$, the output signal of the light receiving elements group 133 is altered in accordance to the magnitude of diversion. Therefore, the magnitude of (diversion) 1x of the sheet P in X direction can be measured by detecting alteration of the output signal of the light receiving element group 133. Now, the image forming position can be corrected, as far as X direction and reduction, by 1x/2 in X direction when an equal size copying is desired and by an amount determined by the equation as described earlier according to the factor of magnification or reduction.

The second optical detector 134 is provided between the roller pair 19 and said electric charger 20 for copying, shown in FIG. 1, for detecting a positional diversion of the sheet P in the direction of its travelling, hereinafter referred to as longitudinal diversion. The detector 134 comprises a light emitting element 135 and a light receiving element 136 which are respectively spaced apart from the resistroller 19 and the surface of the sheet P by predetermined distances. With a detector of such a configuration, the magnitude of longitudinal diversion of the sheet P is determined by the time lag that can be measured by detecting the time when the sheet P is taken out from one of the paper supply cassettes $\mathbf{13}_1$ to $\mathbf{13}_3$ or the paper stack section 128*a* and the time when the leading edge of the sheet P is sensed by the second optical detector 134. Now, when the copying key $\mathbf{30}_1$ is depressed, the dispatcher rollers $\mathbf{14}_1$ to $\mathbf{14}_3$, the roller pairs $\mathbf{15}_1$ to $\mathbf{15}_3$ and the resistroller pair 19 are actuated. If the double side multiplex copying unit 128 is selected, the dispatcher roller 128*e*, separator roller pair 128*f* and the transfer roller pairs 128*h*, 128*j* are also actuated. Of the motors which drive these rollers, the motor 39 which drives the roller pair 19 is a stepping motor as described earlier. Therefore, by counting the pulses which are supplied from the motor 39 by means of said main processor group 71 until the time when the leading edge of the sheet P is detected by the second optical detector 134, the distance that the sheet P has travelled can be determined. If a reference distance for travelling of the sheet P is provided in advance, the discrepancy between the reference value and the measured value, the magnitude of diversion in the longitudinal direction of the sheet P, can be utilized for correction of the image forming position.

Figure 16:
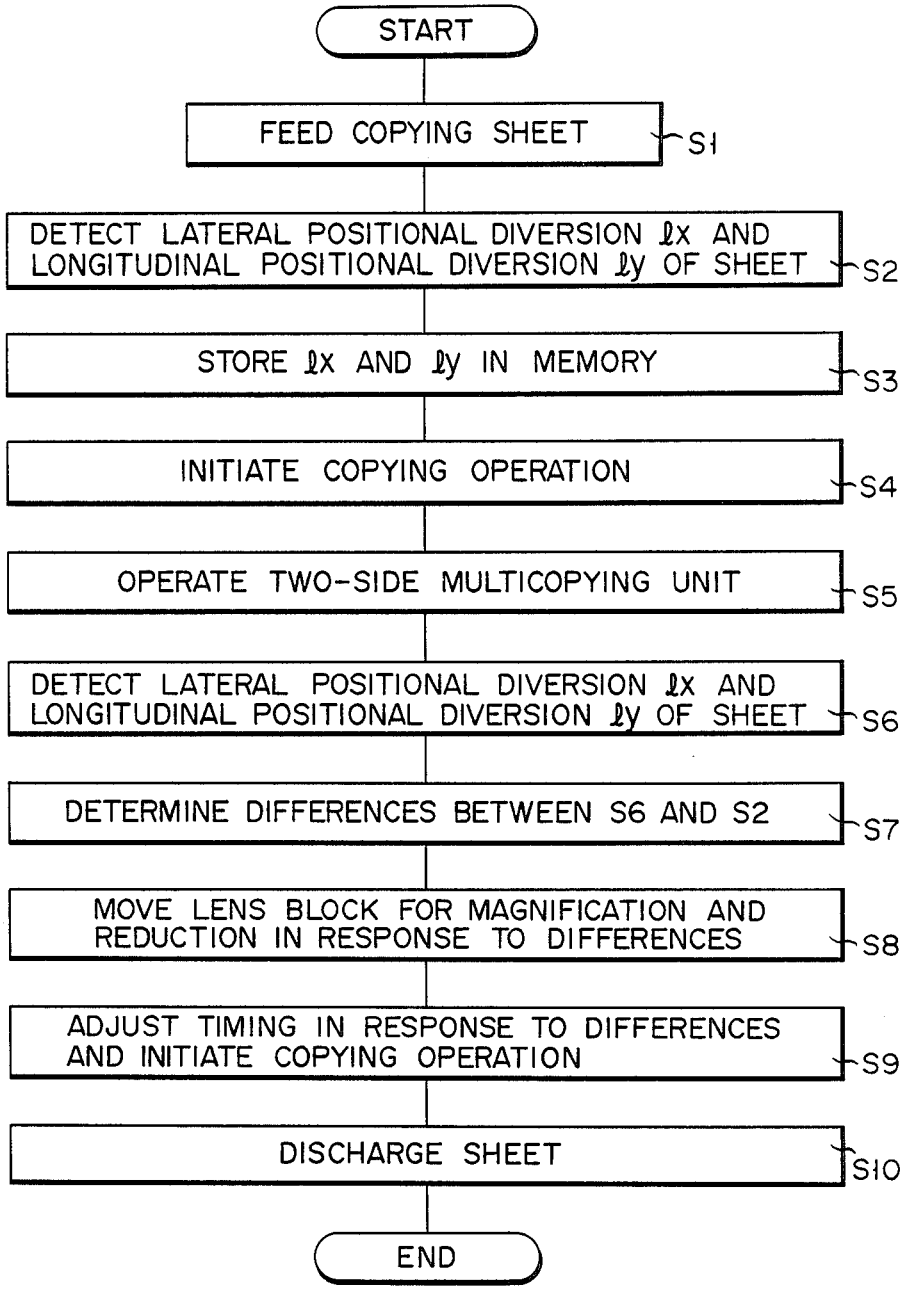

Now the operation of the image forming position correcting function of the present embodiment will be described. If, for example, the multiplex copying specifying key 30*a* of the control panel 30 is depressed for multiplex copying and then the copying key $\mathbf{30}_1$ is depressed, a set of operation control procedures comprising a series of steps as illustrated in the flow chart of FIG. 16 are carried out, in which a sheet P is supplied from a preselected paper supplying cassette in set $S_1$ and then the magnitude of lateral positional deviation $\mathbf{1}x_1$ and that of longitudinal positional deviation $\mathbf{1}Y_1$ of the sheet P are detected by the first and second detectors 130 and 134 respectively in step $S_2$.

The magnitude $\mathbf{1}x_1$ and the magnitude $\mathbf{1}Y_1$ which are determined in step $S_2$ are then stored in said memory 137 in step $S_3$ and, in step $S_4$, a normal copying operation is conducted. After completion of the copying operation, in step $S_5$, the double side multiplex copying unit 128 is actuated and the sheet P on which an image has been formed is stored in the paper stack section 128*a* of the unit 128. Under this condition, if another original is placed on said original table 2 and the copying key $\mathbf{30}_1$ is depressed, the sheet P is once again moved to the copying section of the apparatus. If at this time a lateral deviation and a longitudinal deviation, the magnitudes of which are expressed as $\mathbf{1}x_2$ and $\mathbf{1}y_2$ respectively, are detected, the magnitudes $\mathbf{1}x_2$ and $\mathbf{1}y_2$ are respectively subtracted from the magnitudes $\mathbf{1}x_1$ and $\mathbf{1}y_2$ that are stored in said memory 137 to obtain $Ex=(\mathbf{1}x_1-\mathbf{1}x)$ and $Ey=(ly_1-\mathbf{1}y_2)$. In step $S_6$, the lens block 8 for magnification and reduction is moved laterally to modify the image forming position by an amount which corresponds to the value Ex. If the magnifying power for copying is equal to one (1), the distance by which the lens block 8 for magnification and reduction will be Ex / 2. Then in step $S_9$, where a copying operation is initiated, the operational timing of the roller pair 19 as well as the timing for supplying the sheet P to the copying section are modified by an amount which corresponds to the value Ey. In this way, an image is formed on the sheet P after correction of the image forming position both laterally and longitudinally as in the case of the previous correcting operation. After completion of the image forming operation, in step $S_{10}$, the sheet P on which the image has been formed is discharged into the tray 25 to complete the overall operation.

It should be noted that, if a plural number of sheets of copying paper are set for copying, the amount of lateral deviation and that of longitudinal deviation for each of the sheets whose deviations are detected for the first copying operation are stored in the memory 137 and the sheets that have undergone the first copying operation are stored in the paper stack section 128*a*. Then when the second copying operation is carried out for multiplex copying, the amount of lateral deviation and that of longitudinal deviation for each of the sheets of copying paper which are fed from said paper stack section 128*a* to the copying section for the second copying operation are determined and then respectively subtracted from the amount of lateral deviation and that of longitudinal deviation which are stored in said memory 137 for the sheet to obtain Ex and Ey for positional correction of the sheet.

As described above, according to said first embodiment, the magnitude of the lateral positional deviation 1x of the sheet P and that of the longitudinal positional deviation 1y are detected by the first and second optical detectors respectively and stored in the memory 137 for a first copying operation, the stored values being subtracted from the respective amounts of positional deviations of the sheet P in the succeeding set of copying procedures for a multiplex copying operation and the position of the lens block 8 for magnification and reduction as well as the operational timing of the roller pair 19 being adjusted in response to said differences. In this way, if the sheet P is laterally and/or longitudinally deviated from the normal position when it is placed on the copying section, is such deviation relative the reference position are detected and, after positional correction, an image is formed on the right position of the sheet P. This function of positional correction is particularly advantageous for a multiplex copying machine, where any positional discrepancies among the multiple images on a same sheet of paper formed through mulitple image forming operations can deteriorate the quality of the final outcome.

While the image forming position correction function of the present invention is described in the above description in reference to a multiplex copying operation in the first embodiment, the function can also be used for a double side copying operation as well as a normal copying operation in order to detect any positional diversions of a sheet of copying paper and to form an image on the right position.

Figure 17:
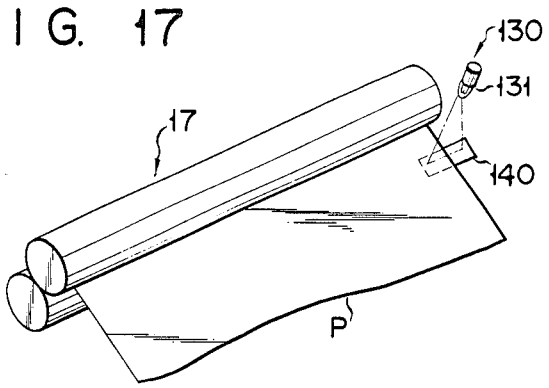
Figure 18:
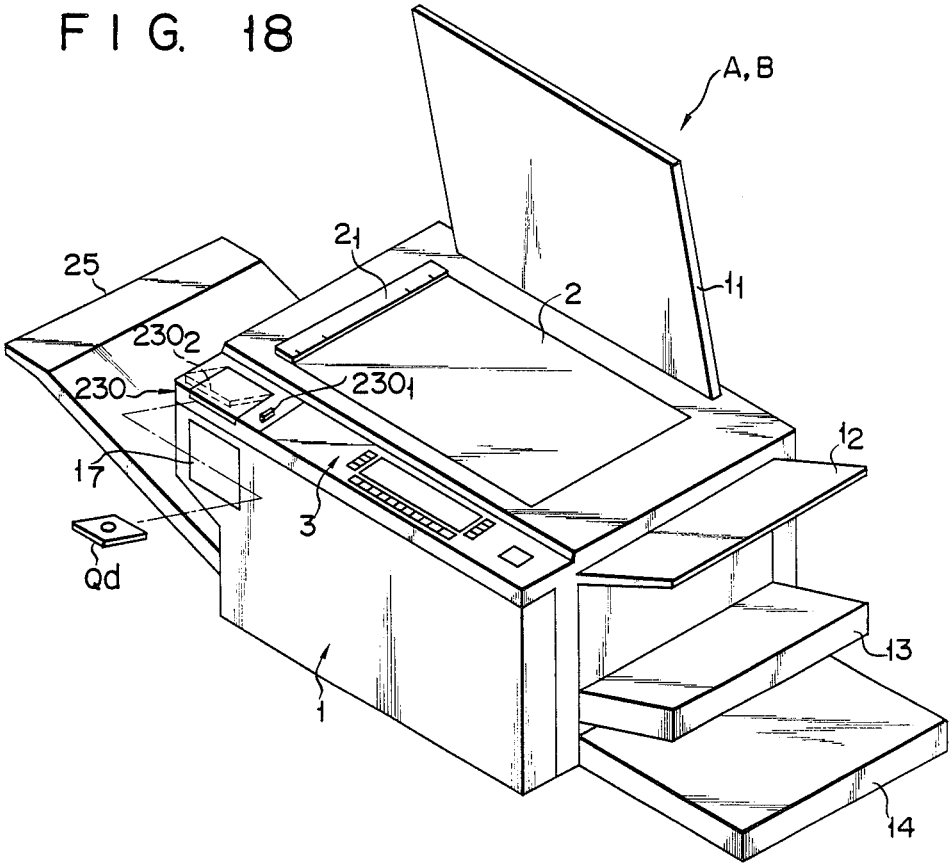

Again, while a plurality of light receiving elements 132 are used for the light receiving element group 133 in the first embodiment, a CCD line sensor 140 as shown in FIG. 17 may be alternatively used for a high precision detection of positional deviations of copying sheets.

Further, for longitudinal correction, not only timing alteration of operation of the roller pair 19 but timing alteration of irradiation scanning relative to paper feeding timing may be used.

It may be apparent from the above description, an image forming apparatus that can eliminate any longitudinal and lateral deviations of an image to be formed on a sheet of copying paper and thereby provide a highly fine and sharp final image.

FIGS. 18 to 21 show alternative configurations of a copying machine A or B or an image forming system comprising two copying machines according to the second embodiment of the present invention. Reference numeral 1 denotes a copying machine housing. Original table (i.e., transparent glass) 2 is fixed on the upper surface of housing 1. Fixed scale $2_1$ as a reference for placing an original is arranged on table 2, and openable original cover $1_1$ and work table $1_2$ are arranged adjacent to table 2. Control panel 3 is arranged on the upper surface of housing 1, and has so-called quick disk device 230 comprising a disk drive mechanism. In device 230, when eject button $230_1$ is depressed, cover $230_2$ is opened, as indicated by a dotted line in FIG. 18. In this state, quick disk Qd, comprising a rotatable magnetic recording medium, can be put into and taken out of device 230.

Figure 19:
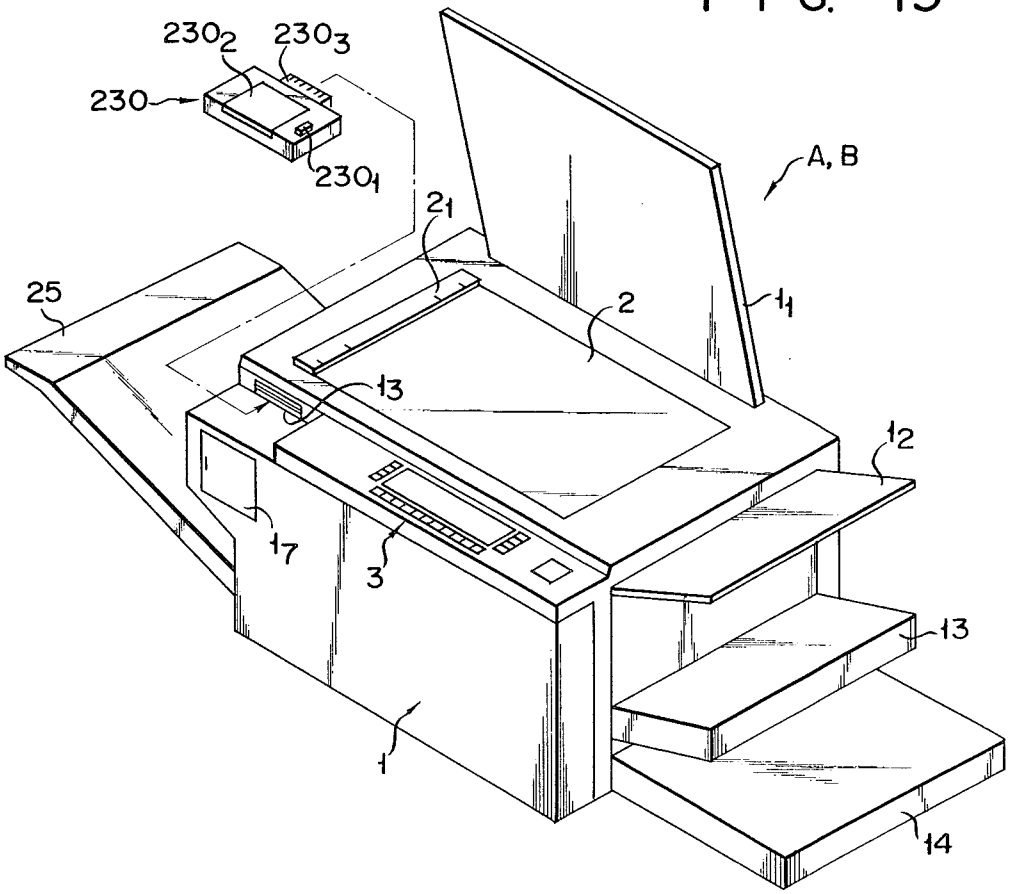

Device 230 is detachably mounted on housing 1, as shown in FIG. 19. More specifically, connection terminal $230_3$ projects from a side surface of device 230, and can be connected and disconnected to and from insertion hole $1_3$ formed in housing 1. When terminal $230_3$ is inserted in hole $1_3$, it is connected to a connection section (not shown) provided in housing 1.

Figure 20:
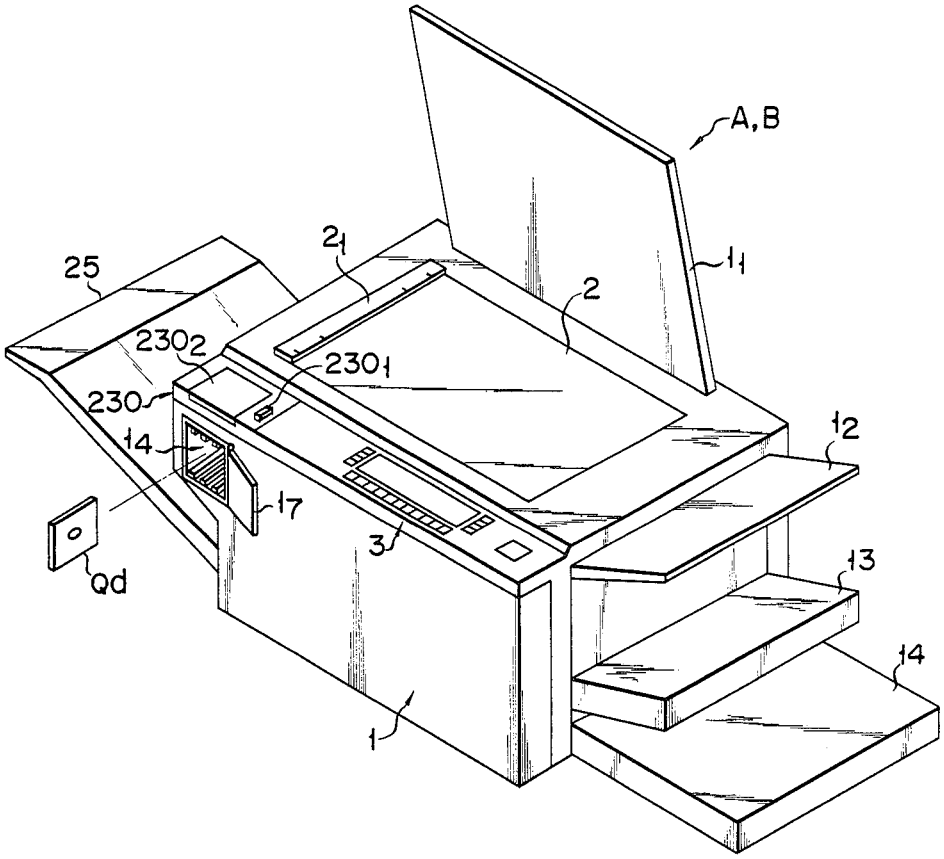
Figure 21:
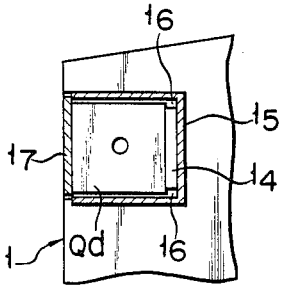

Container section $1_4$ for quick disk Qd is formed in the front surface of housing 1, as shown in FIG. 20. The interior of section $1_4$ comprises metal sealed case $1_5$, and holding member $1_6$ for vertically supporting disks Qd is provided in case $1_5$, as shown in FIG. 21. Openable cover $1_7$ covering section $1_4$ is arranged at the front surface of housing.

Further, the operational sequence of image forming procedures are stored in advance in said quick disk Qd, which also stores the amounts of diversions of a copying sheet (1*x*, 1*y*) as will be described later.

Figure 22:
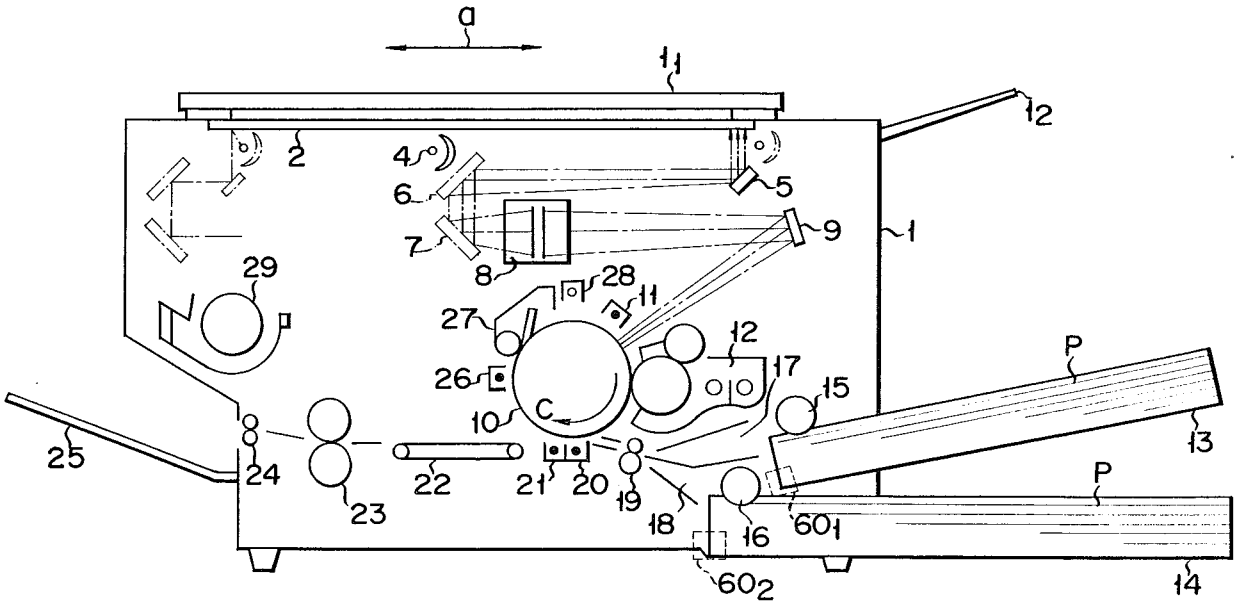

On the other hand, as shown in FIG. 22, the original set on the original table 2 is scanned for image exposure as an optical system including an exposure lamp 4 and mirrors 5, 6 and 7 recriprocates in the direction indicated by arrow a along the under surface of the original table 2. In this case, the mirrors 6 and 7 move at a speed half that of the mirror 5 so as to maintain a fixed optical path length.

A reflected light beam from the original scanned by the opical system, that is, irradiated by the exposure lamp 4, is reflected by the mirrors 5, 6 and 7, transmitted through a lens block 8 for magnification or reduction, and then reflected by a mirror 9 to be projected on a photosensitive drum 10. Thus, an image of the original is formed on the surface of the photosensitive drum 10.

The photosensitive drum 10 rotates in the direction indicated by arrow c so that its surface is wholly charged first by a main charger 11. The image of the original if projected on the charged surface of the photosensitive drum 10 by slit exposure, forming an electrostatic latent image on the surface. The electrostatic latent image is developed into a visible image (toner image) by a developing unit 12 using toner. Paper sheets (image record media) P are delivered one by one from an upper paper cassette 13 or a lower paper cassette 14 by a paper-supply roller 15 or 16, and guided along a paper guide path 17 or 18 to an aligning roller pair 19. Then, each paper sheet P is delivered to a transfer region by the aligning roller pair 19, timed to the formation of the visible image.

The developing unit 12 in the copying machine A is for black color, whereas the developing unit 12 in the copying machine B is for red color.

The two paper cassettes 13 and 14 are removably attached to the lower right end portion of the housing 1, and can be alternatively selected by operation on a control panel which will be described in detail later. The paper cassettes 13 and 14 are provided respectively with cassette size detecting switches $60_1$ and $60_2$ which detect the selected cassette size. The detecting switches $60_1$ and $60_2$ are each formed of a plurality of microswitches which are turned on or off in response to insertion of cassettes of different sizes.

The paper sheet P delivered to the transfer region comes into intimate contact with the surface of the photosensitive drum 10, in the space between a transfer charger 20 and the drum 10. As a result, the toner image on the photosensitive drum 10 is transferred to the paper sheet P by the agency of the charger 20. After the transfer, the paper sheet P is separated from the photosensitive drum 10 by a separation charger 21 and transported by a conveyor belt 22. Thus, the paper sheet P is delivered to a fixing roller pair 23 as a fixing unit arranged at the terminal end portion of the conveyor belt 22. As the paper sheet P passes through the fixing roller pair 23, the transferred image is fixed on the sheet P. After the fixation, the paper sheet P is discharged into a tray 25 outside the housing 1 by an exit roller pair 24.

After the transfer, moreover, the photosensitive drum 10 is de-electrified by a de-electrification charger 26, when the residual toner on the surface of the drum 10 is removed by a cleaner 27. Thereafter, a residual image on the photosensitive drum 10 is erased by a discharge lamp 28 to restore the initial state. In FIG. 22, numeral 29 designates a cooling fan for preventing the temperature inside the housing 1 from rising.

Figure 23:
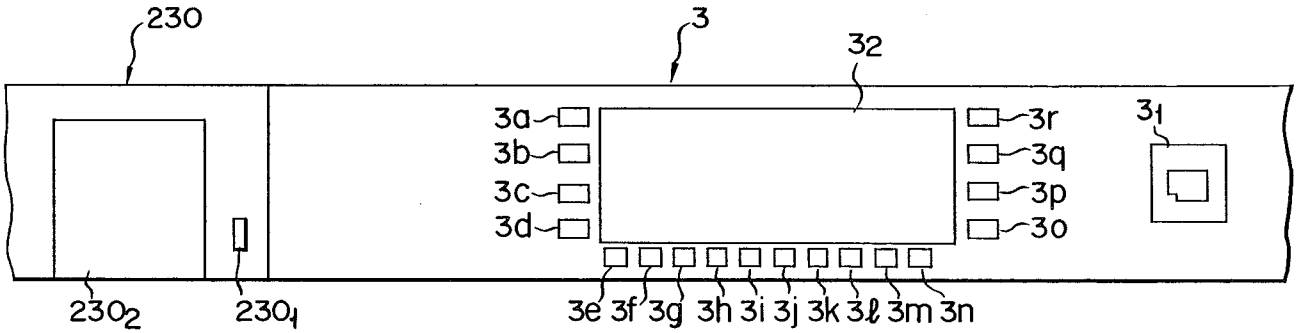

FIG. 23 shows control panel 3 mounted on housing 1. Reference numeral $3_1$ denotes a copy key for starting the copying operation; and $3_2$, a display section comprising a liquid crystal dot matrix display. Section $3_2$ selectively displays display data stored in quick disk Qd in accordance with respective modes. A plurality of setting keys 3*a* to 3*r* for setting different copying functions are provided to surrounded section $3_2$, including ten keys for setting the copying number, a magnification setting key for setting a copying magnification, cassette selection keys for selecting upper and lower paper feed cassettes 13 and 14, and the like, to be described later.

It should be noted that the configuration of the driving mechanism of the first embodiment as illustrated in FIG. 4 from which the two-side multicopying unit 128 and the functionally related sections are taken out is also used for the driving section of the copying machine of this second embodiment. Likewise, the driving mechanism for reciprocal movement of said optical system, the driving mechanism for the indexes 51 and 52 and the driving mechanism for the lens block 8 for magnification and reduction as well as the relationship their operation and the image to be formed are identical to their counterparts of the first embodiment as shown in FIGS. 5, 6, 7, 8A and 8B.

Figure 24:
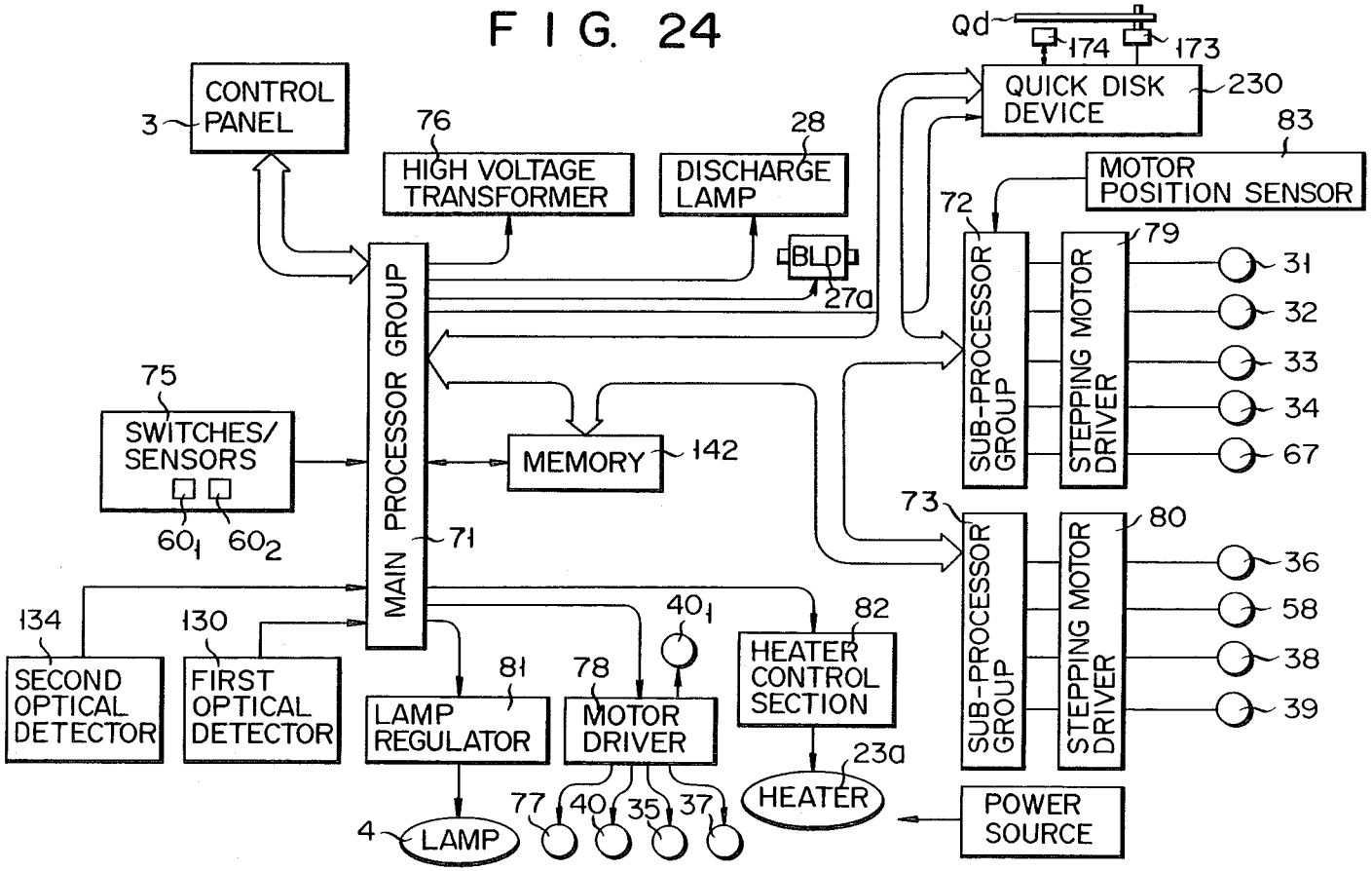

The overall control circuit of the second embodiment as illustrated in FIG. 24 is identical with that of the first embodiment as shown in FIG. 9 except the quick disc unit 230 and the related sections. Namely, the main processor group 71 controls the copying operation in the same manner as described for the first embodiment by detecting lateral and longitudinal diversions for a copying sheet by means of the first and second optical detectors 130, 134 and the memory 142 to correct the image forming position relative to the position of the copying sheet. It also controls the display section $3_2$ through control of the quick disk unit 230 and the memory 142. Said main processor group 71 stores the operational sequence of image forming procedures and the amounts of deviations of a copying sheet (1x, 1y) which are stored in the quick disc unit 230 also in the memory 142.

The quick disc unit 230 controls the motor 173 which drives the quick disk Qd to rotate at a constant speed and the write-in/read-out head 174 which writes-in and/or reads-out date from the quick disc Qd which is rotating at a constant speed.

The operation of the first and second optical detectors 130, 134 are identical as the description of the optical detectors of the first embodiment which is made earlier with reference to FIGS. 15A, 15B, 16 and 17.

All the other control operations described earlier in connection with the first embodiment are also applicable to the present embodiment. Hence, the configuration of the main processor group 71, those of the first and second sub-processor groups 72, 73 and the control circuits for the stepping motors as well as their respective speed control procedures as shown in FIGS. 10, 11, 12, 13 and 14 respectively for the first embodiment are applicable to the second embodiment.

Figure 25A:
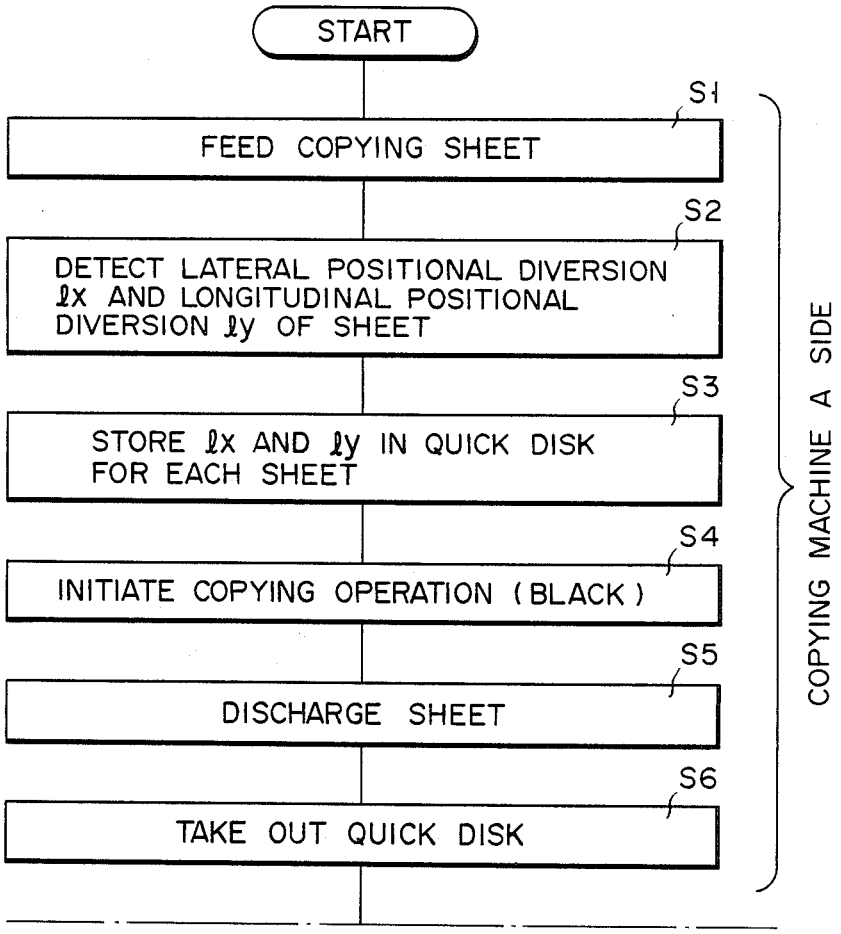
FIGS. 25A and 25B are flow charts for explaining a copying operation of the image forming apppartus.
Figure 25B:
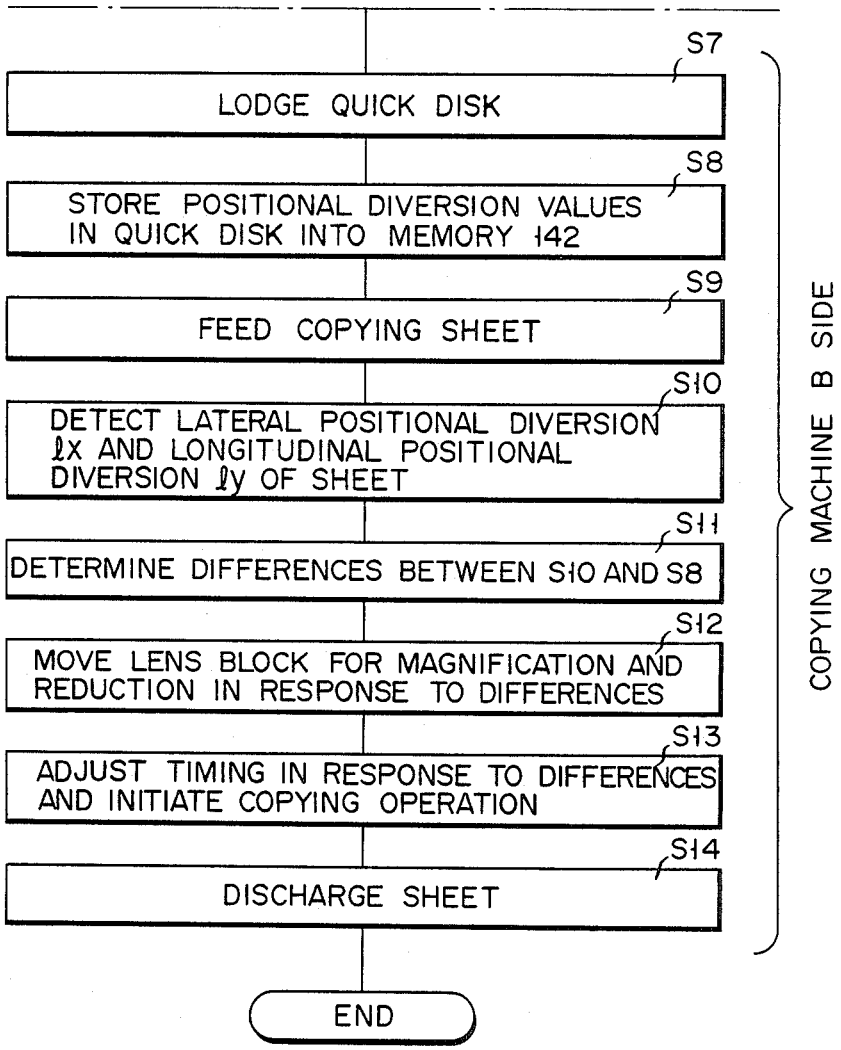
Figure 26:
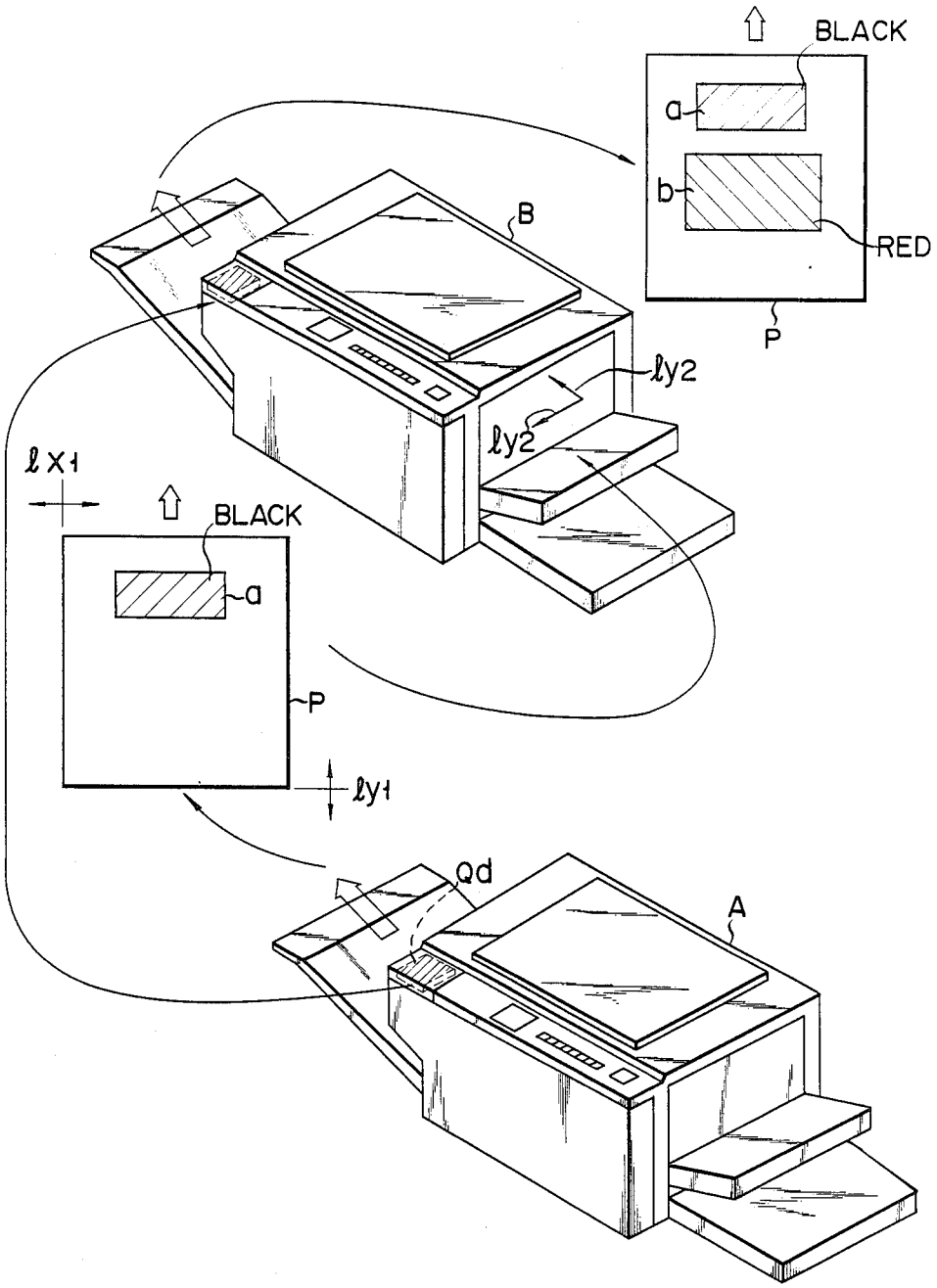

Now, in reference to the flow chart of FIG. 25 and the illustration of FIG. 26, the operation of the second embodiment of an image forming apparatus according to the present invention will be described. When a first original, or an original for copying in black color, is placed on the original table 2 of the copying machine A and the copying key $3_1$ of said control panel 3 is depressed, a control operation comprising the steps S1 to S6 are illustrated in the flow chart of FIG. 25 is initiated, where, in step S1, a sheet of copying paper P is supplied from a selected paper supply cassette and, in step S2, the magnitude of lateral deviation $1x_1$ and that of $1y_1$ of the sheet P are detected respectively by the first and second optical detectors. The detected magnitudes $1x_1$ and $1y_1$ are stored in said quick disc Qd in step S3. Then, in step S4, a normal copying operation is conducted. After completion of the copying operation, in step S5, the sheet P on which a black image is formed in discharged to the tray 25 and thereby the overall operation is completed. Thereafter, an identical copying operation is conducted on each of the succeeding sheets in the same manner and the magnitudes of deviations $1x_1$, $1y_1$ for each of the sheets are stored in said quick disc Qd until a predetermined number of sheets undergo the copying operation. Then the quick disc Qd is taken out from the accommodated position.

Next, a second original, or an original for coying in red color, is place on the original table 2 of the copying machine B and the copying sheets on which the image of the first original is copied are lodged in a paper supply cassette. Then the quick disc Qd which was used for the copying operations in said copying machine A is set in the quick disc unit 230 (S7).

Through this setting of the quick disk Qd, the stored data concerning the positional deviations of the sheets are now stored in the memory 142 (S8). If, thereafter, the copying key $3_1$ is depressed, the main processor group 71 performs a control operation as illustrated by the flow chart steps 9 to 14 in FIG. 25.

In this operation, in step S9, a copying sheet P is supplied from a preselected paper supply cassette and, in step S10, the sheet P is checked for its lateral and longitudinal deviations $1x_2$ and $1y_2$. In step S11, the newly determined values $1x_2$ and $1y_2$ are respectively subtracted from the values $1x_1$ and $1y_1$ which are stored in said memory 142 to obtain the relative deviation values $Ex=(1x_1-1x_2)$ and $Ey=(1y_1-1y_2)$. Then in step S12, the lens block 8 for magnification and reduction is laterally moved by a distance which corresponds to Ex to adjust the image forming position in response to the lateral positional deviation of the sheet P. If the magnifying power for copying is equal to one (1), the distance by which the lens block 8 for magnification and reduction will be Ex/2.

Next, when a copying operation is initiated in step S13, the operational timing of the roller pair 19 is altered in response to the longitudinal positional deviation value Ey which is determined in a manner as described above so that the timing for supplying the sheet P to the copying section is altered accordingly. Thus, an image is formed on the sheet P whose position is corrected in terms of both lateral and longitudinal deviations due to not only the previous sheet feeding operation but also the present sheet feeding operation. After completion of the copying operation, in step S14, the sheet P on which a black image and a red image are copied is discharged to the tray 25 and thereby the overall operation for the sheet comes to an end.

When a plurality of copying sheets are involved in this operation, the lateral and longitudinal deviation values for each of the sheets which are determined during the copying operation on the copying machine A are stored in the quick disk Qd and the sheets on each of which a black image if formed are then accommodated in the tray 25. Then, at the time when a copying operation is conducted on the copying machine B, the lateral and longitudinal deviation values for each of the sheets which are sequentially transferred to the copying section from said paper supply cassette are detected and are subtracted from the corresponding values for the copying machine A which are stored in said memory 142 (quick disc Qd) to determine the differences thereof and thereby correct the image forming position for each sheet.

As described above, in the second embodiment of the present invention, the lateral positional deviation value 1x and the longitudinal positional deviation value 1y of a copying sheet P are determined for the copying machine A by the first and second optical detectors 130 and 134 respectively and are stored in the quick disc Qd on one hand and the corresponding values for the copying machine B are also stored in the quick disc Qd on the other. Then the values for the machine A are subtracted from the corresponding values for the machine B respectively. The differences thus determined are then used to adjust the position of the lens block 8 for magnification and reduction as well as the operational timing of the resistroller pair 19 and thereby form an image on the correct position for each of the sheets.

Therefore, with this embodiment, even if the position of a sheet which is transferred from the paper supply cassette to the copying section is laterally and/or longitudinally deviated, an image can be formed on the right position.

This image forming position correcting function of the present invention is particularly advantageous when a multiplex copying system comprises a plurality of copying machines to form separate images on a same sheet of paper because any positional discrepancies among the separate images are eliminated and an excellent quality of the final imagery outcome is assured.

As described above, the second embodiment of the present invention assures elimination of any positional discrepancies between a plurality of images which are separately formed on different image forming units of a multiplex copying system through the image forming position correcting function and thereby production of excellent copied images.

It is apparent that a number of modifications can be made to the described embodiments according to the present invention within the scope of the invention.

What is claimed is:

1. An image forming apparatus with forming position correcting function, said apparatus comprising:

an original table;

original scanning means for optically scanning an original placed on said original table to obtain a scanned optical image that corresponds to the image of said original;

image receiving medium feeding means for feeding an image receiving medium to a given feeding path;

image forming means for forming an image corresponding to said scanned optical image obtained by said original scanning means on said image receiving medium with a given magnification;

positional deviation detecting means for detecting a quantity of any positional deviation of said image receiving medium in the direction of its feeding and in the direction perpendicular to its feeding direction;

positional deviation storing means for storing the data for any positional deviations detected by said positional deviation detecting means;

first control means for generating forming position correcting data in response to the positional deviation data that have been read out from said positional deviation storing means; and second control means for transmitting said forming position correcting data generated by said first control means to a positioning means which substantially affects the forming position on said image receiving medium by said image forming means.

2. Apparatus according to claim 1, wherein said image receiving medium feeding means comprises means for returning the image receiving medium on which an image based on said scanned optical image is formed by said image forming means to said given feeding path.

3. Apparatus according to claim 1, wherein said first control means comprises means for generating image forming position correcting data in response to the difference between the positional deviation values which are read out from said positional deviation storing means and the corresponding positional deviation values which are newly detected by said positional deviation detecting means.

4. Apparatus according to claim 1, wherein said positional deviation detecting means comprises optical detectors.

5. Apparatus according to claim 1, wherein said second control means transmit signals to control supply timing of said image receiving medium against said image forming means to said image forming medium feeding means as said forming position correcting data.

6. Apparatus according to claim 1, wherein said second control means transmit signals to control said given magnification in said scanned optical image to said image forming means as said forming position correcting data.

7. Apparatus according to claim 1, wherein said second control means transmit signals to control said optical scanning timing to said original scanning means as said forming position correcting data.

8. Apparatus according to claim 1, which further comprises data storage means which store said positional deviation data that are read out from said positional deviation storing means on a data storage medium and read out selectively said positional deviation data from said data storage medium.

9. Apparatus according to claim 8, wherein said data storage means is a quick disk device comprising rotary magnetic storage means that can be selectively and removably located as said data storage medium.

* * * * *